US005726692A

United States Patent [19]

Yamaguchi et al.

[11] Patent Number: 5,726,692

[45] Date of Patent: Mar. 10, 1998

[54] INK JET RECORDING APPARATUS WITH RECORDING HEADS ARRANGED ON BASIS OF INK DRYING INDEX

[75] Inventors: Shuichi Yamaguchi; Seiji Mochizuki; Masahiro Nakamura, all of Nagano, Japan

[73] Assignee: Seiko Epson Corporation, Tokyo, Japan

[21] Appl. No.: 413,837

[22] Filed: Mar. 30, 1995

[30] Foreign Application Priority Data

Mar. 31, 1994 [JP] Japan ..... 6-85792

[51] Int. Cl.[6] ..... B41J 29/38; B41J 2/165

[52] U.S. Cl. ..... 347/23; 347/29; 347/32; 347/10; 347/11

[58] Field of Search ..... 347/23, 29, 32, 347/35, 33, 30, 19, 186, 10, 11, 53, 187

[56] References Cited

U.S. PATENT DOCUMENTS

| | | | |
|---|---|---|---|
| 4,967,204 | 10/1990 | Terasawa et al. | 347/11 |
| 5,049,898 | 9/1991 | Arthur et al. | 347/19 |
| 5,109,234 | 4/1992 | Otis, Jr. et al. | 347/23 |
| 5,146,243 | 9/1992 | English et al. | 346/140 R |
| 5,298,923 | 3/1994 | Tokunaga et al. | 347/30 |
| 5,329,293 | 7/1994 | Liker | 347/11 |
| 5,363,132 | 11/1994 | Ikkatai | 347/24 |
| 5,371,531 | 12/1994 | Rezanka et al. | 347/43 |
| 5,379,061 | 1/1995 | Yamaguchi et al. | 347/30 |
| 5,495,271 | 2/1996 | Koitabashi et al. | 347/23 |
| 5,600,349 | 2/1997 | Keefe | 347/11 |

FOREIGN PATENT DOCUMENTS

| | | | |
|---|---|---|---|
| 20481829 | 4/1992 | European Pat. Off. | B41J 13/00 |
| 20559122 | 9/1993 | European Pat. Off. | B41J 21/165 |

OTHER PUBLICATIONS

Patent Abstracts of Japan, M-1012, p. 75, JP 02-141247 A (Seiko Epson Corp) 30 May 1990 **abstract.

Patent Abstracts of Japan, JP-A-06 071 906, Mar. 15, 1994, * abstract.

Patent Abstracts of Japan, JP-A-01 202 453, Aug. 10, 1990, * abstract.

*Primary Examiner*—Benjamin R. Fuller
*Assistant Examiner*—Thien Tran
*Attorney, Agent, or Firm*—Sughrue, Mion, Zinn, Macpeak & Seas, PLLC

[57] ABSTRACT

A recording head has a plurality of nozzle opening trains for respectively ejecting different inks having different drying indices, and corresponding cap members disposed outside a printing region. Clogging of ink is efficiently prevented by disposing the nozzle opening train having ink with a higher drying index closer to the cap members than the nozzle opening train with a lower drying index. Timers detect times for idle ejection. When only the nozzle opening train with the higher drying index must perform an idle ejection, a controller positions it opposite the cap member nearest the printing area; the other nozzle opening train is thus not, at that time, positioned opposite a cap member.

14 Claims, 19 Drawing Sheets

| | | | | |
|---|---|---|---|---|
| ELAPSED TIME T1 | 2 | 2.5 | 3 | |
| EJECTION NUMBER OF BLACK INK | 5 | 10 | 15 | |
| ELAPSED TIME T2 | 6 | 7 | 8 | 9 |
| EJECTION NUMBER OF COLORED INKS | 10 | 15 | 20 | 25 |

INK JET RECORDING APPARATUS WITH RECORDING HEADS ARRANGED ON BASIS OF INK DRYING INDEX

BACKGROUND OF THE INVENTION

1. Field of the Invention

The invention relates to an ink jet printer comprising a plurality of ink jet recording heads moving in the width direction of a recording sheet and ejecting ink of different colors according to print data to print a color image, and an ink jet recording apparatus in which a plurality of ink jet recording heads are mounted on the same carriage for high density printing, and more particularly to an ink managing technique which is suitable for such a recording apparatus.

2. Background Art

A conventional recording apparatus having an ink jet recording head produces relatively low level noise during a printing process, and can form small dots at high densities. Such recording apparatus are therefore used in a wide variety of printing processes, including color printing.

The above described recording apparatus ejects ink pressurized in a pressurizing chamber from a nozzle in the form of ink drops on a recording sheet, to form dots on the sheet. In order to improve the printing quality, it is necessary to prevent ink from blurring on a recording sheet. In order to achieve this, the proportion of an ink solvent is reduced to a level as low as possible, or a material that is easily evaporated is used as an ink solvent. However, such countermeasures have drawbacks in that the ink solvent evaporates through nozzle openings during the printing process to increase the viscosity of the ink, and, even if a nozzle face is sealed by a cap during a quiescent period, the viscosity of the ink is still increased. These phenomena impede the ink ejection.

In order to solve these problems, a configuration is disclosed in, for example, Japanese Patent Publication (Kokai) No. SHO64-40,342, in which, when a predetermined period has elapsed in a printing process, a recording head is moved to an ink receptacle located in a nonprinting region and ink is then ejected from all nozzle openings.

Since development of personal computers allows graphic processing to be executed in a relatively simple manner, a printer which can output a hard copy of a color image displayed on a screen is required. In view of the differences in ink consumption and recording density between colors, and also the prevention of discoloration during a quiescent period, color ink jet printers are configured so that two recording heads, i.e., a recording head for black and white printing and a recording head for color printing, are mounted on a carriage.

When different kinds of ink are to be used as described above, the drying indices of these inks are different from each other. Accordingly, a technique is proposed in which the period of an idle ejection and the ejection amount are determined for each of the recording heads, and, when each of the periods is completed, the corresponding recording head is moved to a cap member so that the ink viscosities of the recording heads are prevented from being increased (Japanese Patent Publication (Kokai) No. Hei 2-217,256).

The conventional apparatus are problematic in that, when the times for starting an idle ejection of recording heads are close to each other, the printing process must be interrupted frequently, and the recording heads must be moved so as to oppose the respective cap members, whereby the printing speed is reduced.

SUMMARY OF THE INVENTION

The instant invention is intended to solve the above-described problems. It is an object of the invention to provide an ink jet recording apparatus which can efficiently prevent increased viscosity and clogging of ink in a recording head having plural nozzle opening trains for respectively ejecting different types of ink having different drying indices.

In order to solve these problems, the apparatus of the invention comprises: a plurality of ink jet recording heads which are arranged in a moving direction of a carriage at fixed intervals; cap members which are disposed outside a printing region and which seal the ink jet recording heads, respectively; timer means for detecting elapsed time during which the ink jet recording heads conduct an idle ejection; and control means for disposing an ink jet recording head for ejecting ink having a lower drying index for a relatively long time period among the ink jet recording heads, in the side of the printing region, and when only an ink jet recording head for ejecting ink having a higher drying index for a relatively short time period is to conduct an idle ejection, for locating the ink jet recording head for ejecting ink having a higher drying index in the printing region side of the cap members. According to this configuration, the moving distance of the carriage in the case where a nozzle opening train for ejecting ink having a higher drying index is to conduct an idle ejection can be shortened to a value as small as possible and the total printing speed can be improved.

BRIEF DESCRIPTION OF THE DRAWING FIGURES

Figure 8A:
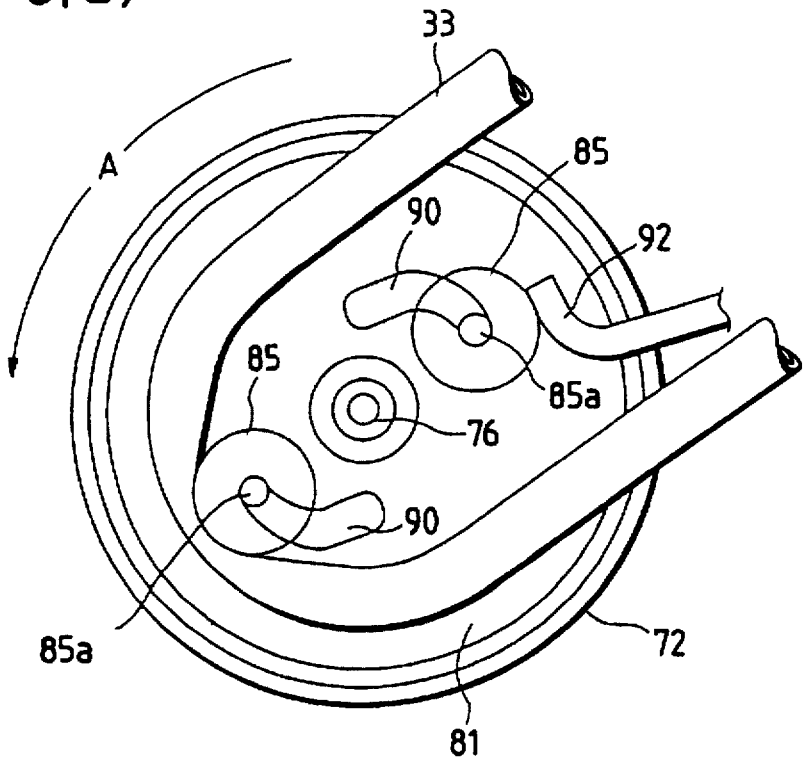
Figure 8B:
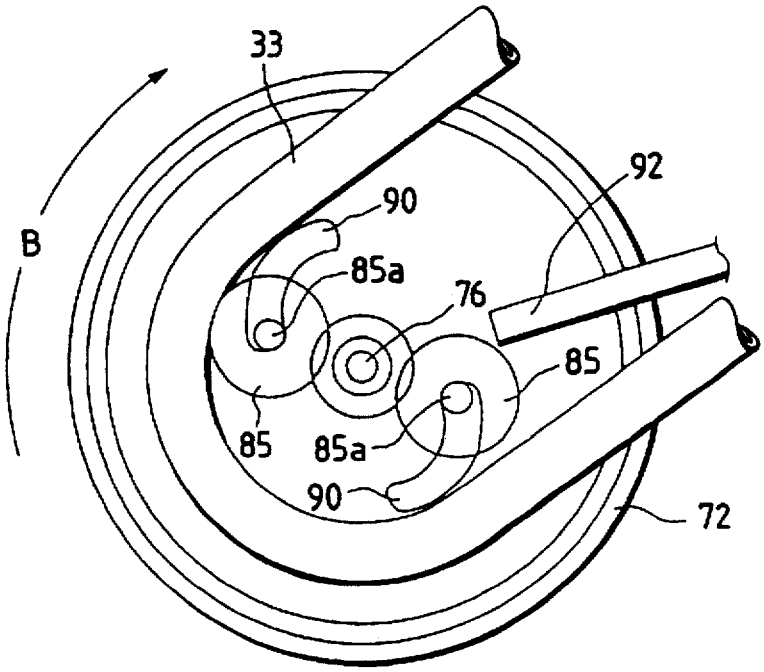

FIGS. 8(*a*) and 8(*b*) are diagrams showing the shape of slots formed in a driving wheel constituting a tube pump which is a first tube pump.

Figure 9:
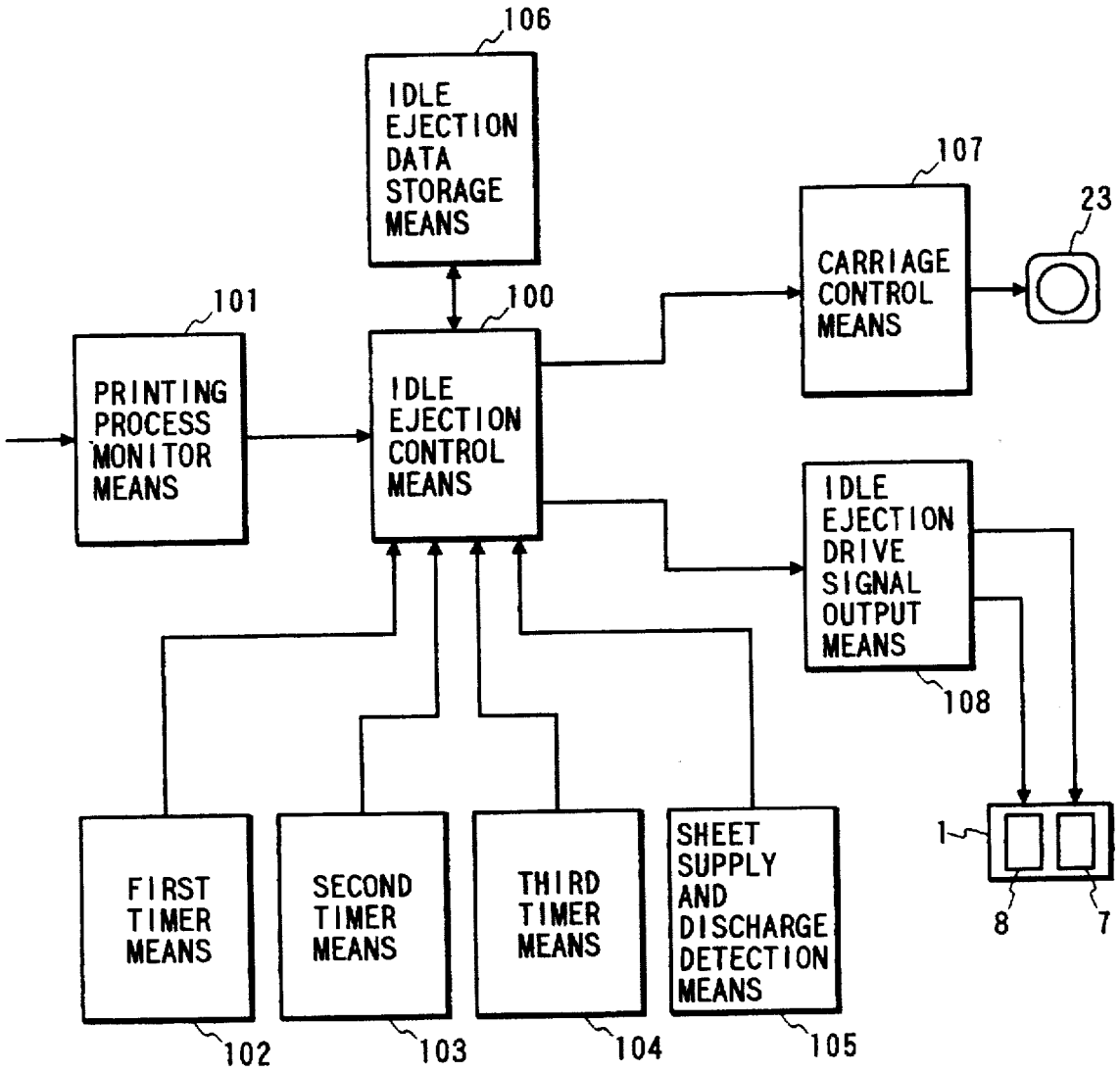

FIG. 9 is a block diagram showing an embodiment of a control device which controls the ink ejection restoring operation in the apparatus.

Figures 10, 16:
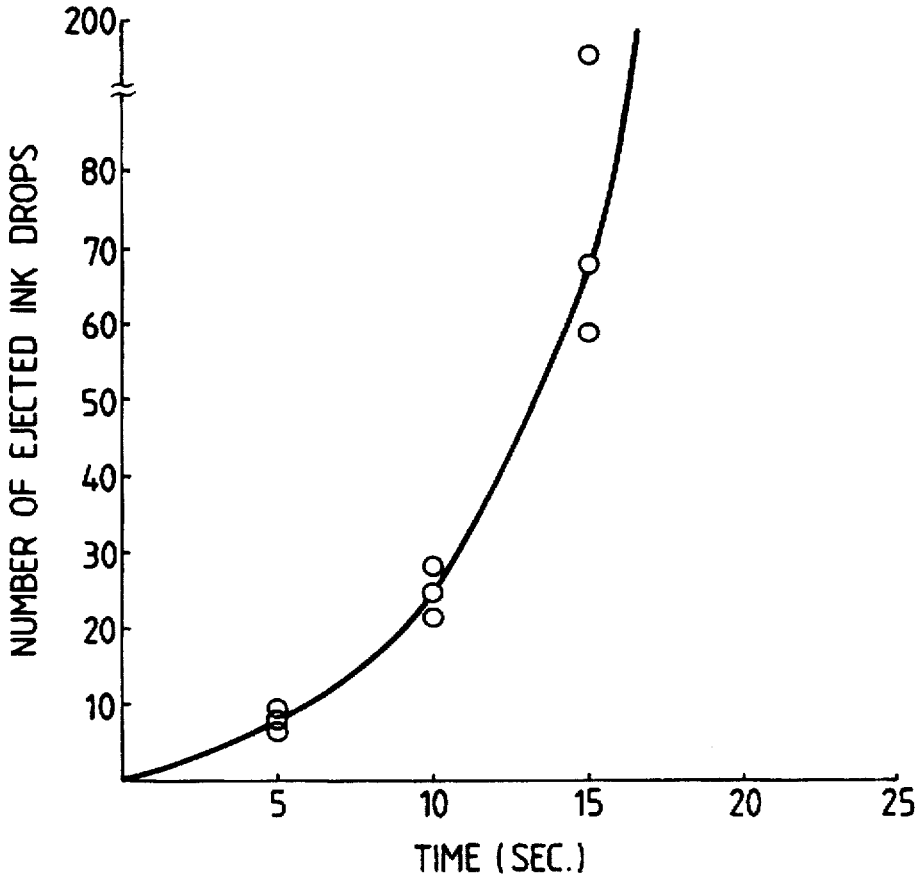

FIG. 10 is a view diagrammatically showing data which are stored in idle ejection data storage means.

Figures 11A, 11B, 11C, 11D:
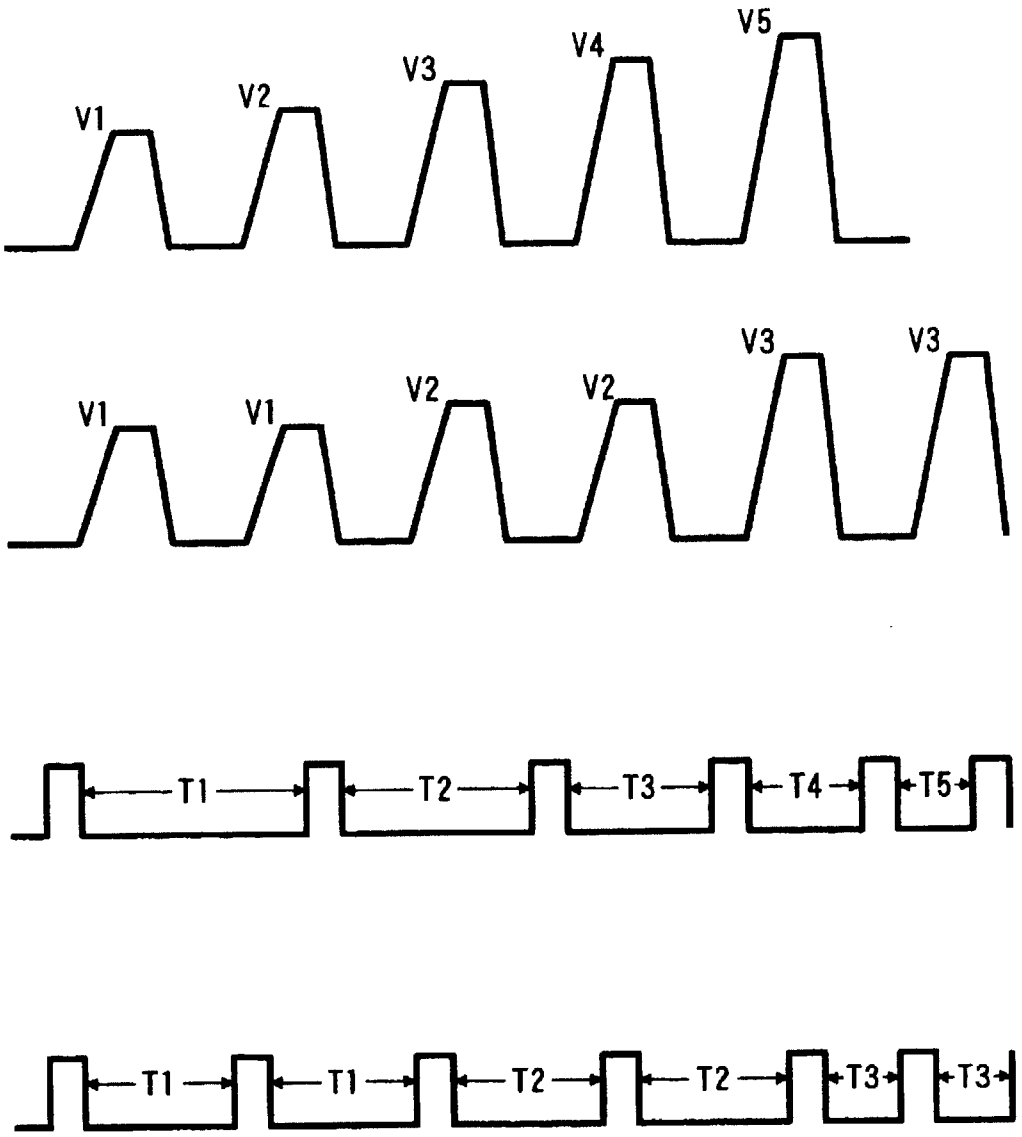

FIGS. 11(*a*) to FIG. 11(*d*) are waveform charts respectively showing an embodiment of a signal for driving the recording heads in the idle ejection process.

Figure 12:
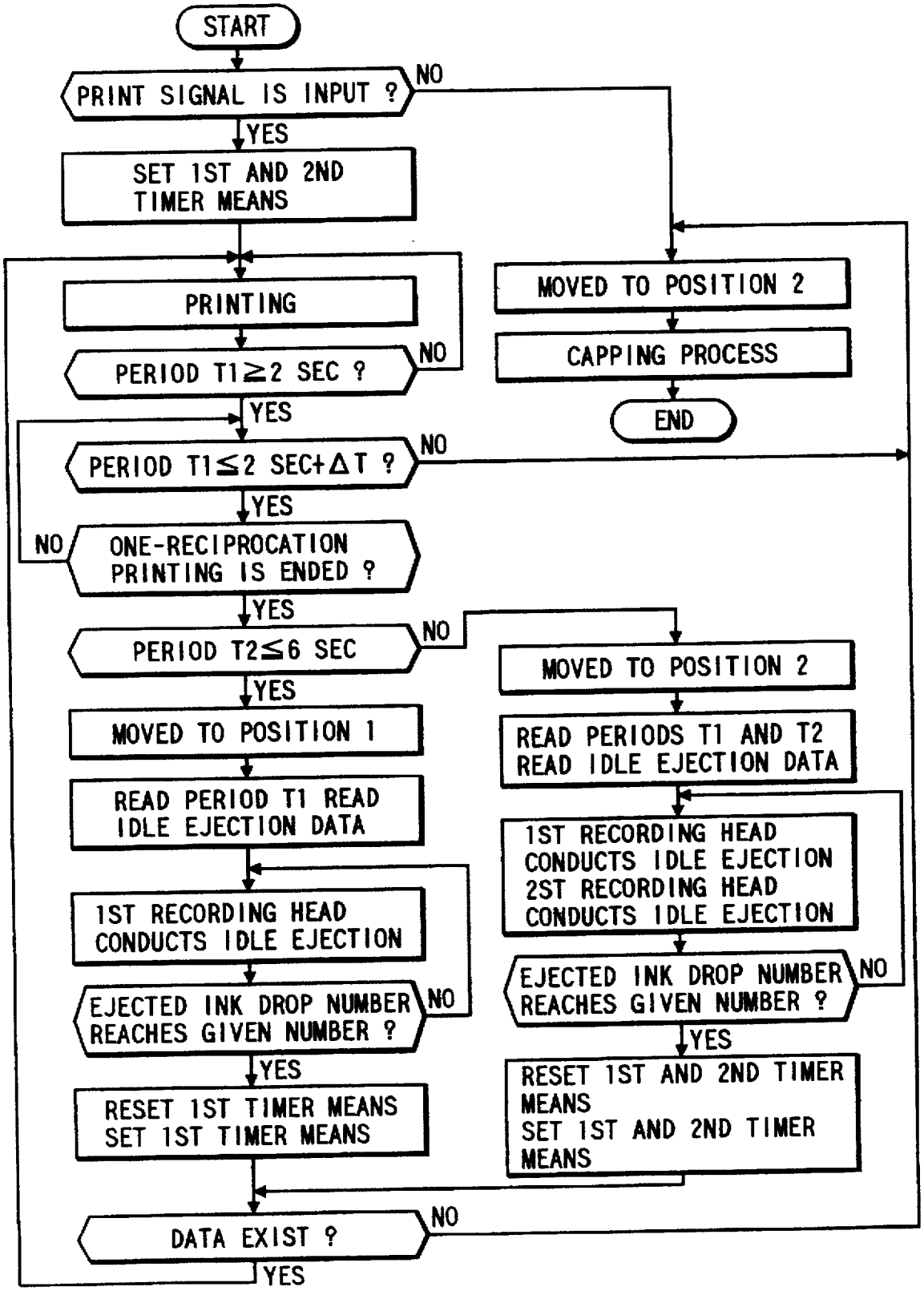

FIG. 12 is a flowchart showing the operation of the apparatus in the printing process.

Figure 13:
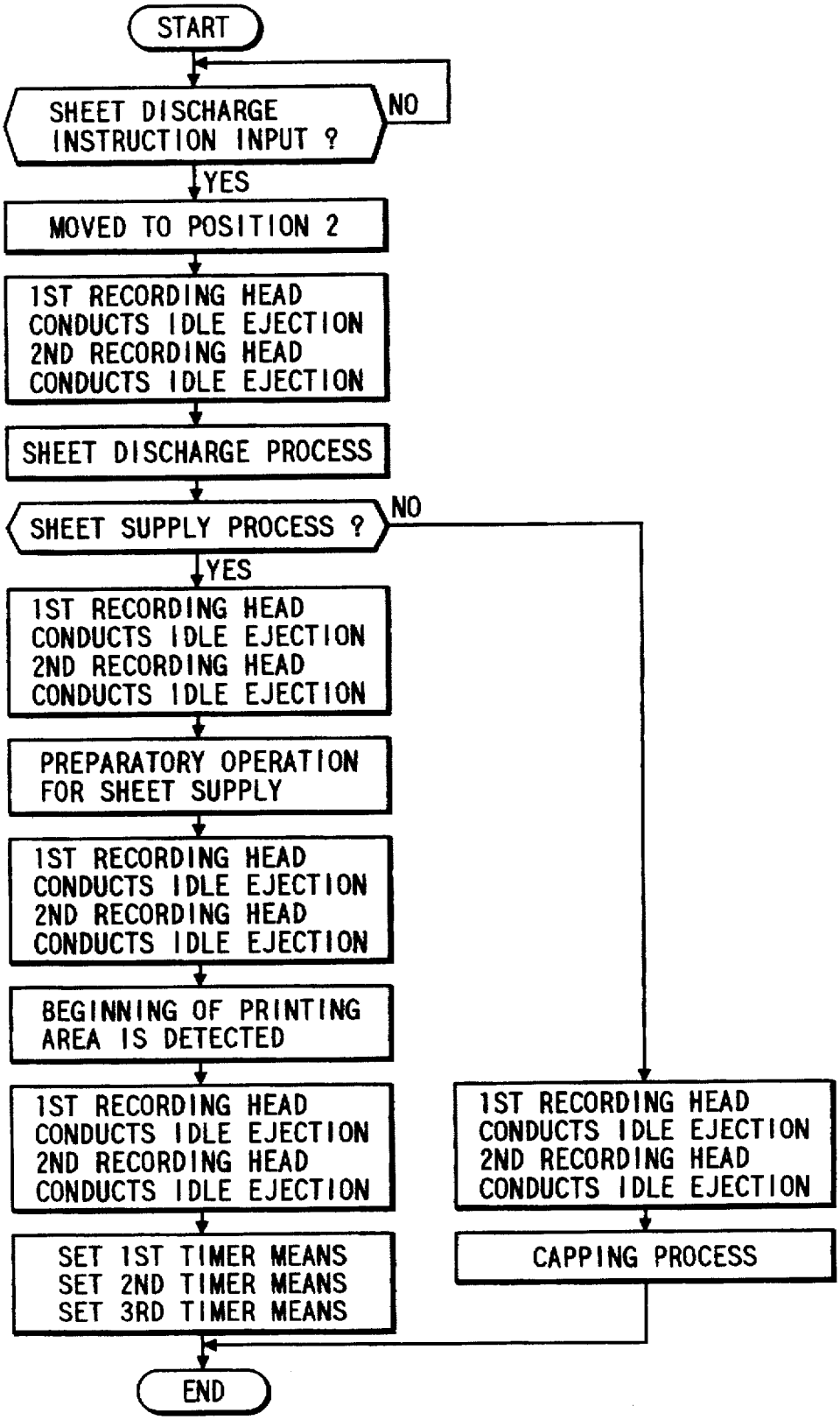

FIG. 13 is a flowchart showing the operation of the apparatus in the sheet supplying process.

Figure 14:
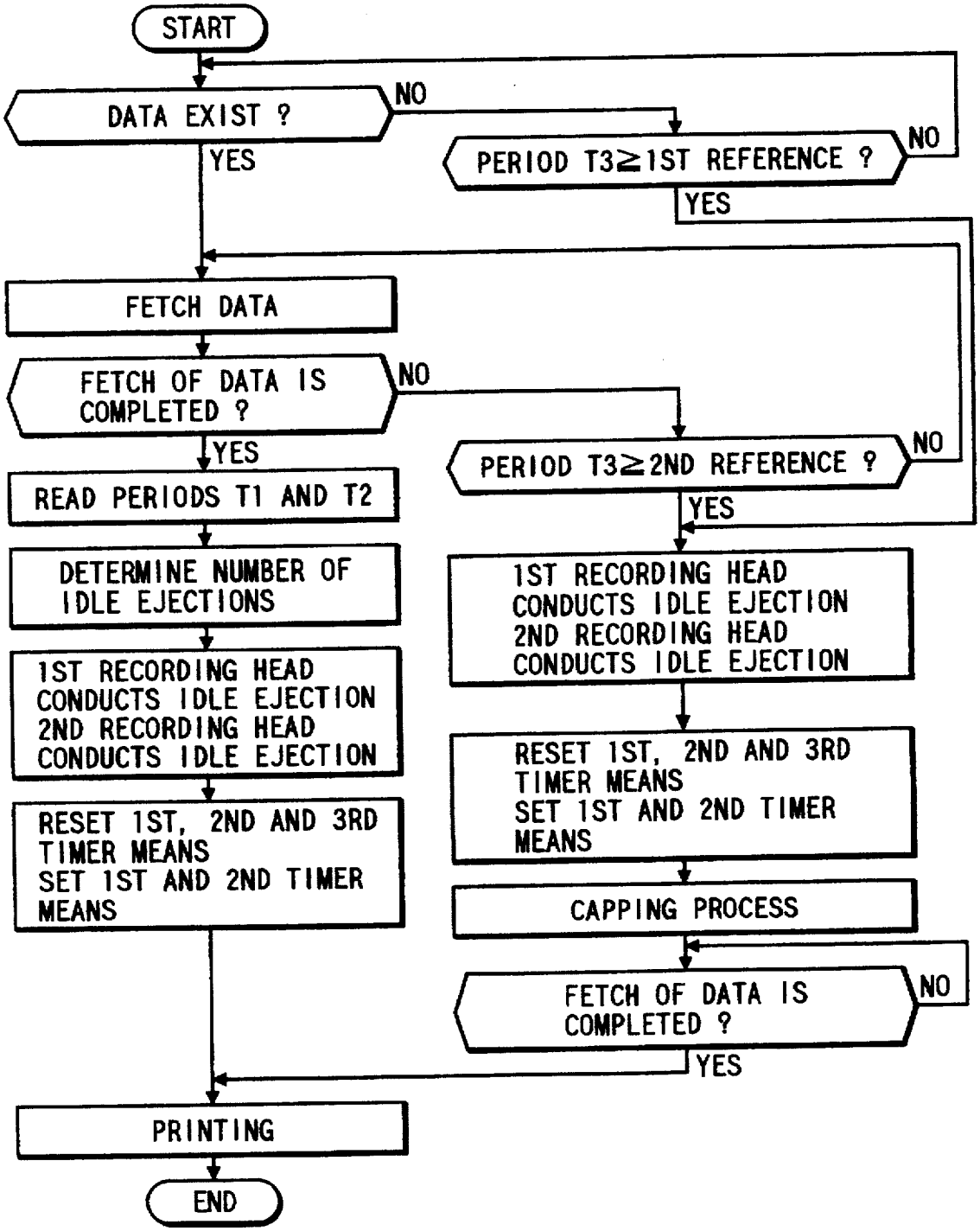

FIG. 14 is a flowchart showing the operation of the apparatus in the when waiting for print data.

Figures 15A, 15B, 15C, 15D:
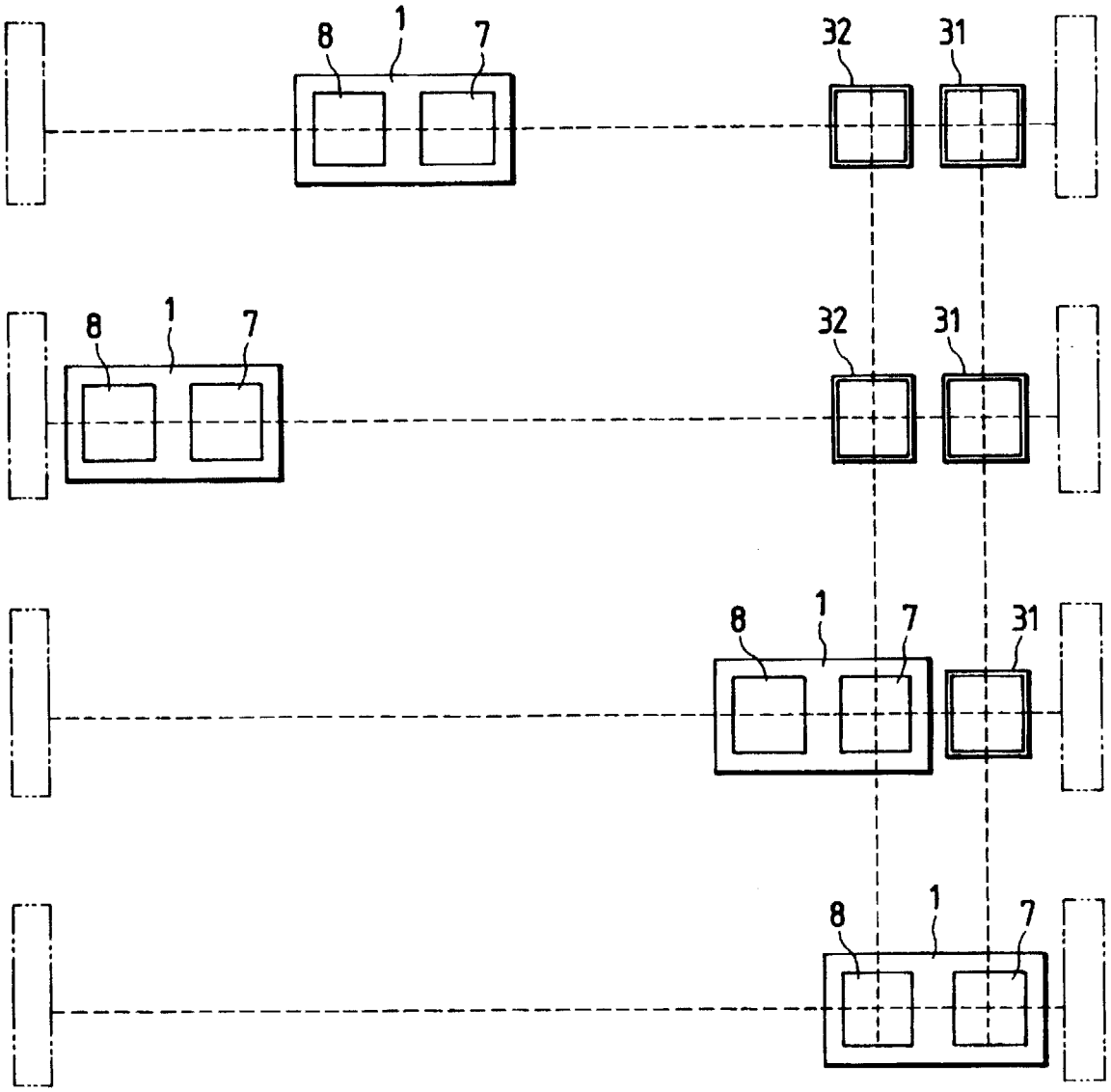

FIGS. 15(*a*) to FIG. 15(*d*) are diagrams respectively showing the positional relationships between first and second recording heads and the first and second cap members.

FIG. 16 is a graph showing the relationship between the idle ejection period and the number of ink drops to be ejected which is required for restoring the ink ejection ability of the nozzle openings.

Figure 17:
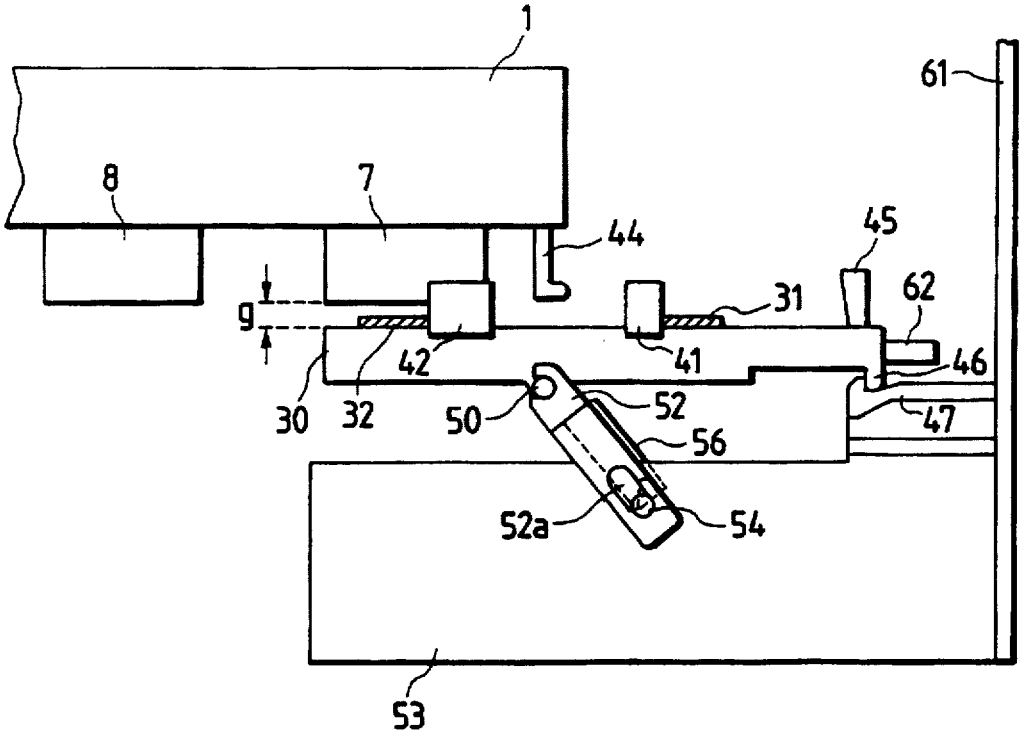

FIG. 17 is a diagram showing the relationship between the recording heads and the cap members in the case where a carriage is moved to position 1.

Figure 18:
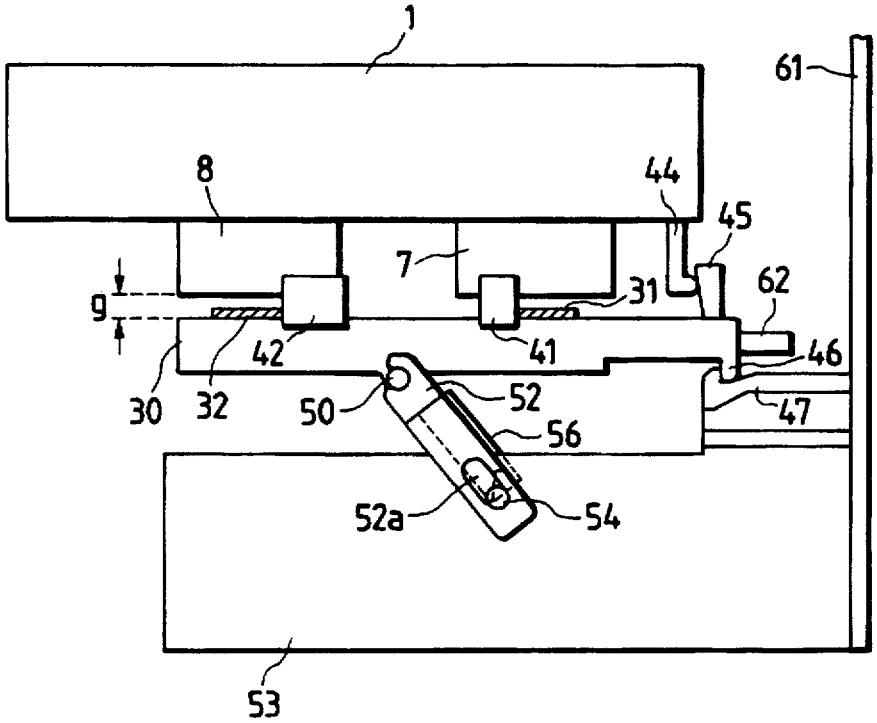

FIG. 18 is a diagram showing the relationship between the recording heads and the cap members in the case where the carriage is moved to position 2.

Figure 19:
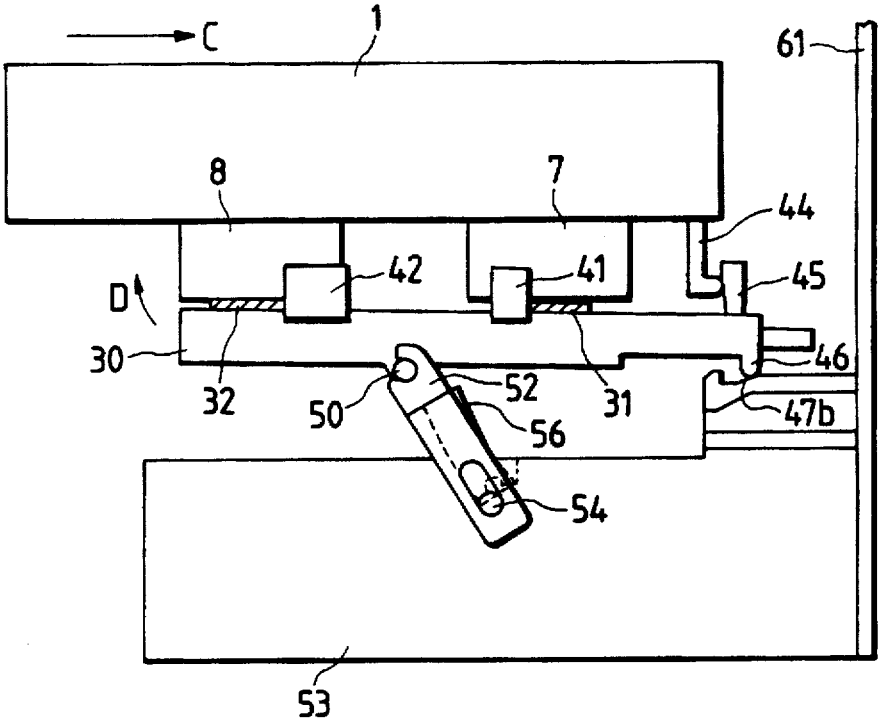

FIG. 19 is a diagram showing the relationship between the recording heads and the cap members in the case where the carriage is slightly moved from the state of FIG. 18 to the outside of the printing region.

Figure 20:
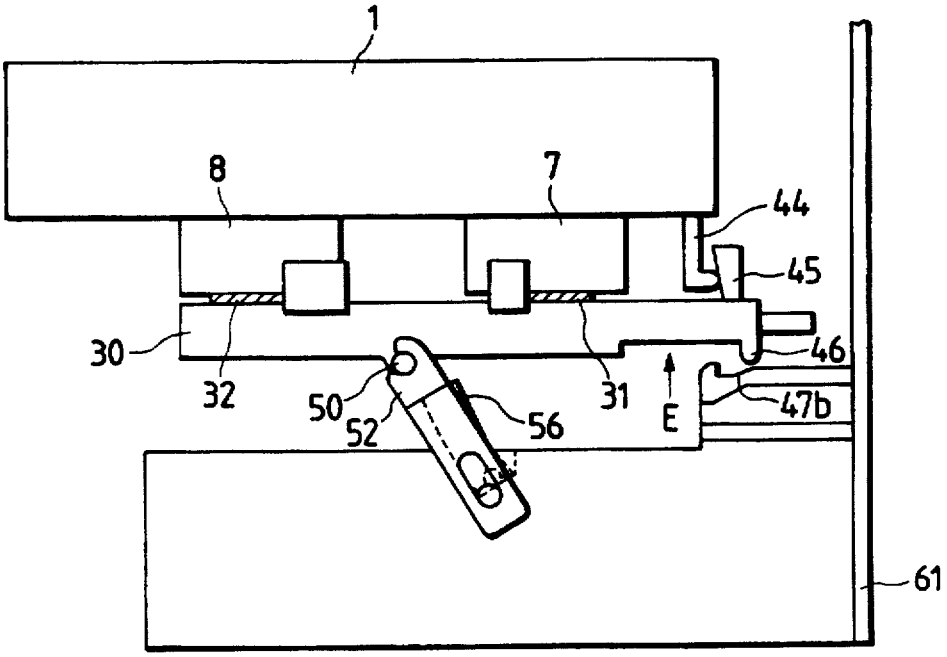

FIG. 20 is a diagram showing the state where two recording heads are capped by cap members.

Figure 21:
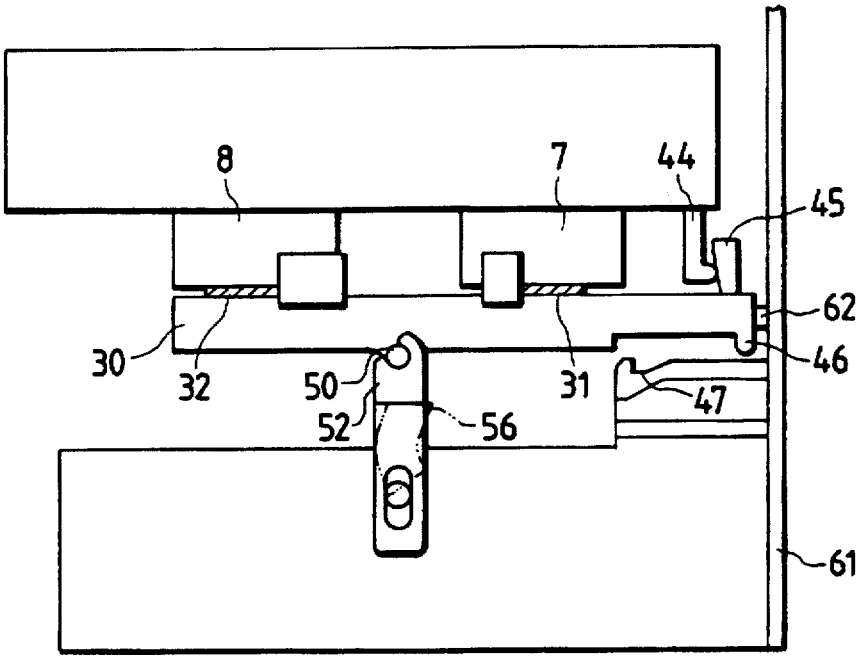

FIG. 21 is a diagram showing the state where the capped recording heads are further moved to the outside of the printing region and the communication between the cap members and the air is interrupted.

Figure 22A:
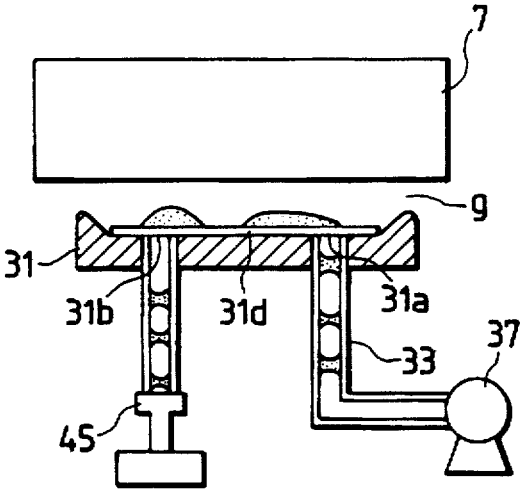
Figure 22B:
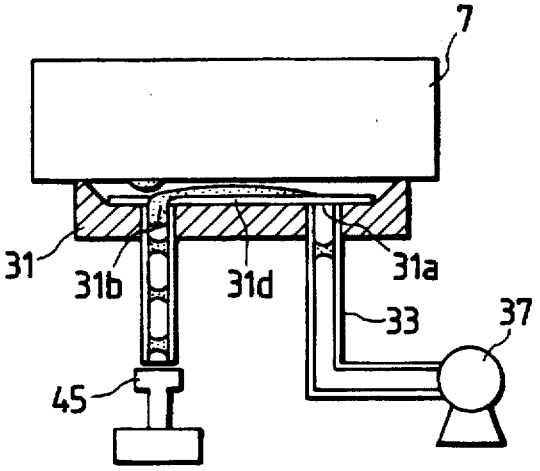

FIGS. 22(*a*) and 22(*b*) are diagrams respectively illustrating the flow of ink in first and second suction processes.

Figure 23A:
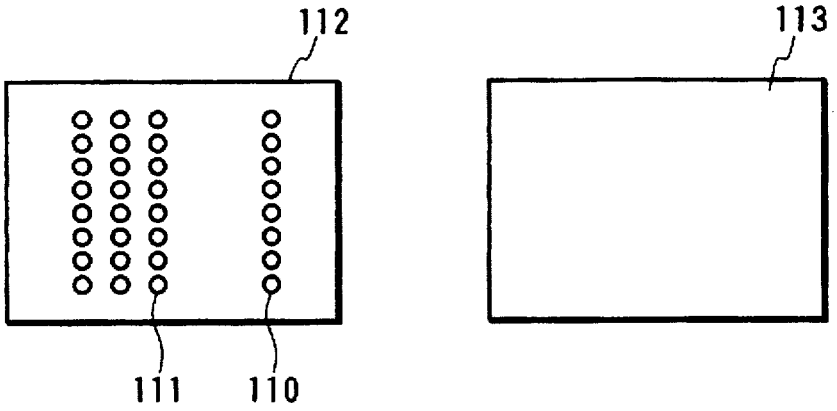
Figure 23B:
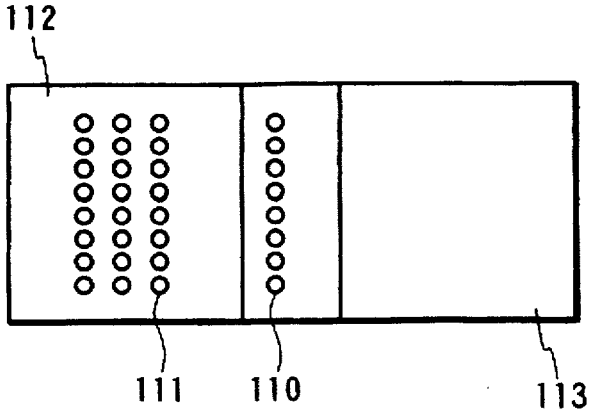

FIGS. 23(*a*) and 23(*b*) are diagrams respectively showing other embodiments of the invention.

DETAILED DESCRIPTION OF THE PREFERRED EMBODIMENTS

The invention will be described in detail in conjunction with illustrated embodiments.

Figure 1:
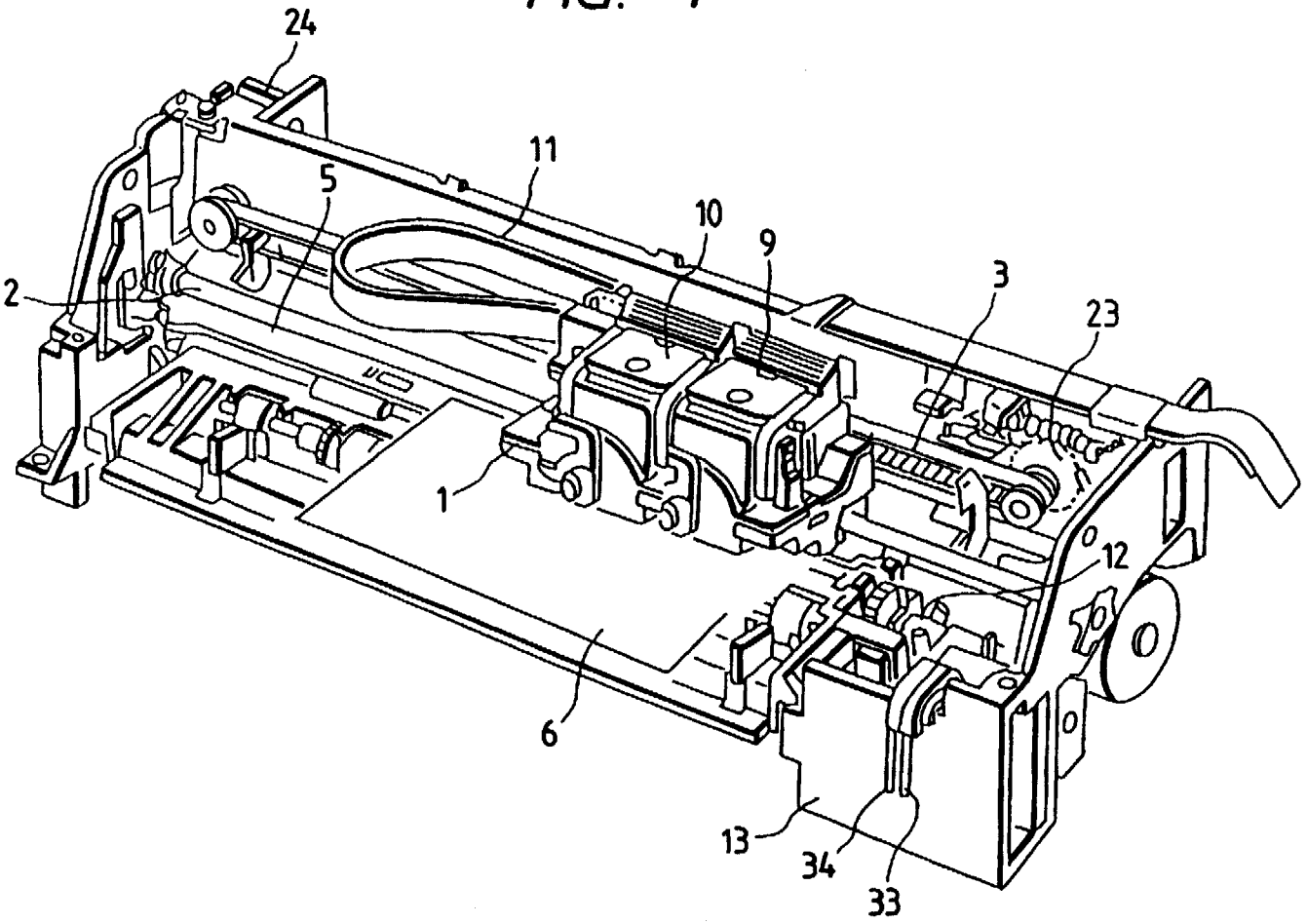
FIG. 1 is a perspective view showing the structure of a printing mechanism of an ink jet recording apparatus of the invention.

FIG. 1 diagrammatically shows a printing mechanism of an ink jet recording apparatus of the invention. In the figure, reference numeral 1 designates a carriage which is supported by a guide member 2 and coupled with a pulse motor 23 through a timing belt 3 so as to be reciprocally movable in a direction parallel to a platen 5.

Recording heads having nozzle opening trains for ejecting different types of ink containing ink solvents of different evaporation rates are mounted on the carriage 1. In the embodiment, a first ink jet recording head 7 having nozzle opening trains for ejecting black ink having a relatively high drying index, and a second ink jet recording head 8 having nozzle opening trains for ejecting colored inks (FIG. 4) are mounted so as to be separated by a fixed distance from each other in the printing direction, i.e., the moving direction of the carriage 1. A black ink cartridge 9 and a colored ink cartridge 10 are detachably mounted in the upper portions of the recording heads 7 and 8, respectively. A capping device which seals the recording heads 7 and 8 is disposed outside the printing region.

When the recording heads 7 and 8 in this configuration receive a drive signal from a head driving circuit (not shown) through a flexible cable 11, the recording heads are supplied with ink from the ink cartridges 9 and 10 and form black and colored dots on a recording sheet 6 which is placed so as to oppose the recording heads.

Figure 2:
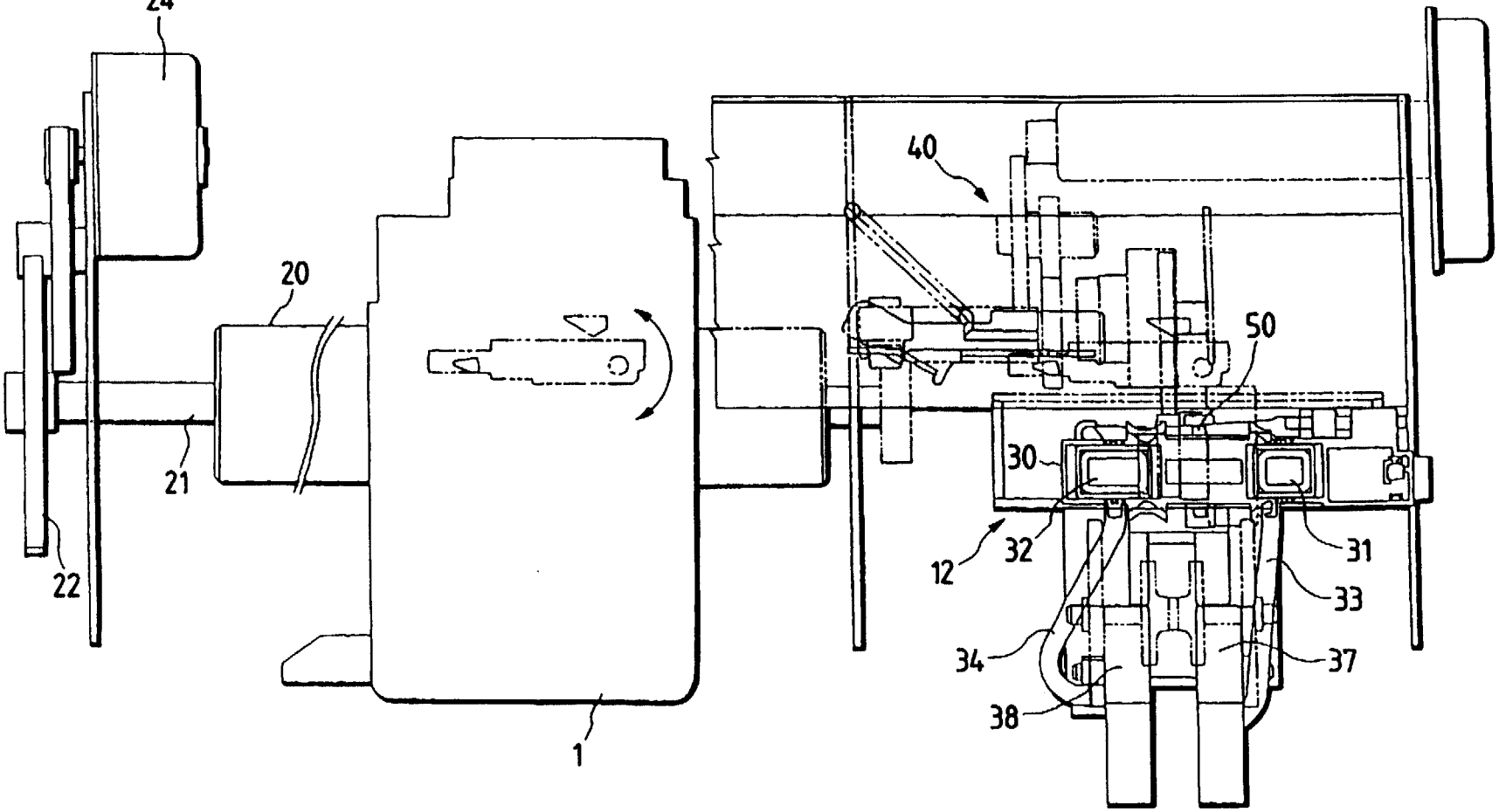
FIG. 2 is a plan view of the capping device.

FIG. 2 is a diagram showing an upper face in the vicinity of the capping device. In the figure, the reference numeral 20 designates a sheet feed roller. The sheet feed roller 20 is coupled with a pulse motor 24, which is used for feeding a sheet and driving pumps, by a gear 22 which is fixed to one end of a rotation shaft 21. The sheet feed roller 20 feeds the recording sheet 6 in synchronization with the printing process.

In the figure, reference numeral 12 designates the above-mentioned capping device. First and second cap members 31 and 32 which are made of an elastic material and have a cup-like shape are disposed on a slider 30. The slider 30 is located in a manner so as to be interlocked with the movement of the carriage 1, at either of two positions, i.e., a capping position where the capping device covers the faces of the two recording heads 7 and 8 on which nozzles are opened (hereinafter, such a face is referred to as "nozzle opening face"), and a noncapping position where the capping device is separated from the nozzle opening faces. In the cap members 31 and 32, the opening area is selected so that the cap members can hermetically seal the respective recording heads 7 and 8 and surely receive ink drops ejected from the recording heads 7 and 8 in the state where the cap members are separated from the respective heads.

The first and second cap members 31 and 32 are respectively provided with suction ports 31*a* and 32*a* (FIG. 3) which are connected to ends of tubes 33 and 34 constituting parts of tube pumps 37 and 38, so as to be subjected to suction forces generated by the tube pumps.

The first and second tube pumps 37 and 38 are selectively driven by the sheet feed and pump motor 24 through a wheel train 40 to conduct a suction operation. More specifically, when the motor 24 is reversely rotated, only the first tube pump 37 conducts a suction operation, and, when the motor 24 is forward rotated, only the second tube pump 38 conducts a suction operation.

Figure 3:
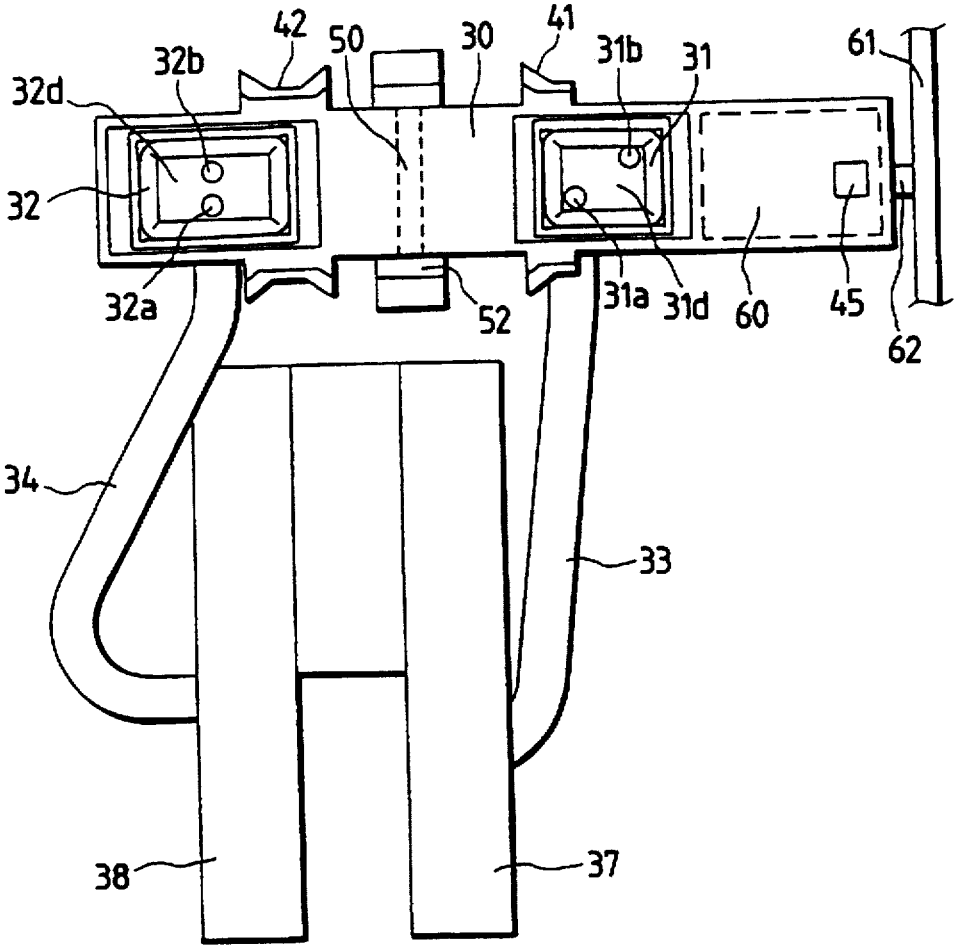
FIG. 3 is a plan view showing an embodiment of the capping device.
Figure 4:
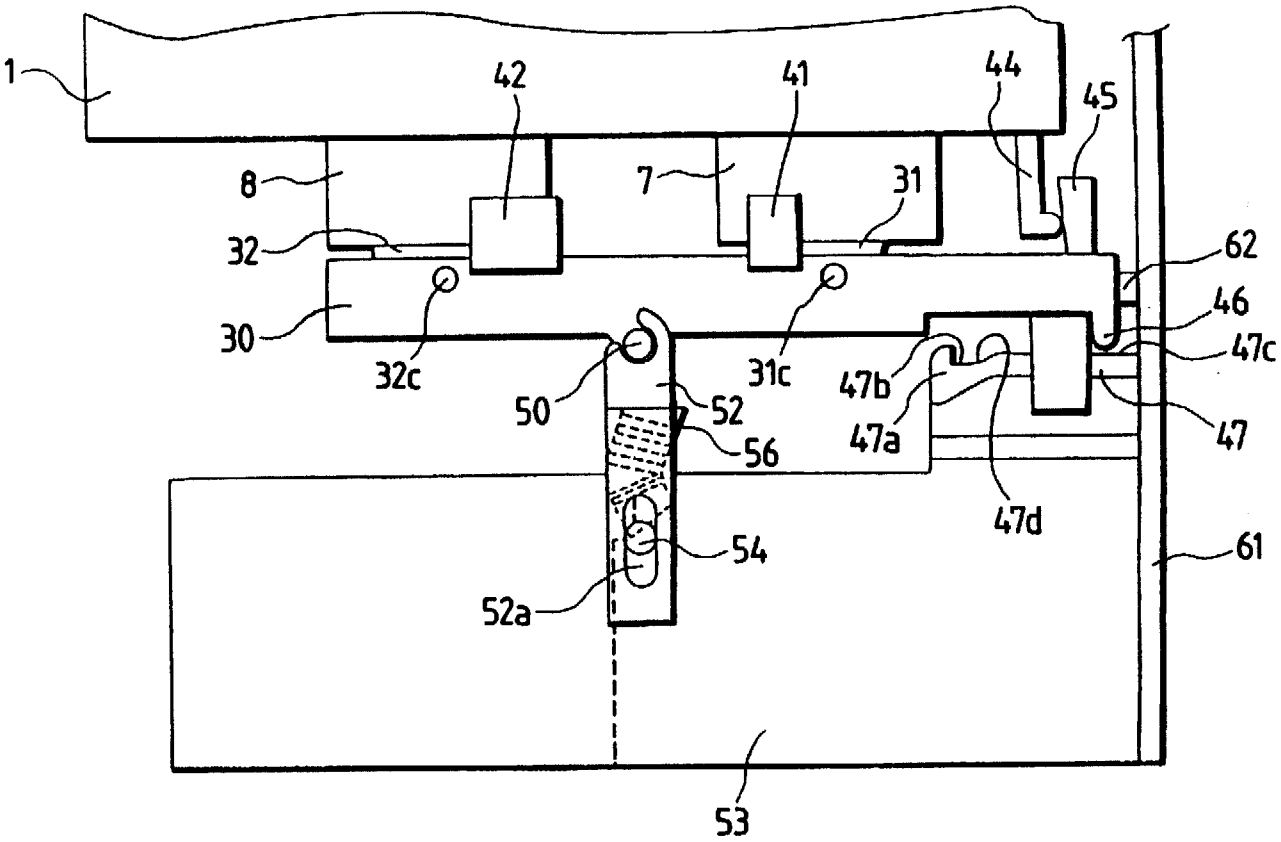
FIG. 4 is a front view showing the embodiment of the capping device in the state where the capping device abuts against recording heads.

FIGS. 3 and 4 show an embodiment of the above-described capping device 12. In the figures, reference numeral 30 designates the slider which is disposed so that the first and second cap members 31 and 32 are swingable about shafts 31*c* and 32*c* in accordance with the distance between the two recording heads 7 and 8 mounted on the carriage 1.

In the figures, reference numerals 41 and 42 designate first and second guide pieces, each of which consists of two subpieces that are disposed on both sides of the first and second recording heads 7 and 8 mounted on the carriage 1, so as to correspond to the widths of the heads. The first and second guide pieces are separated from each other by a distance so that, when the carriage 1 is set at a predetermined position, they oppose the recording heads 7 and 8, respectively. At one end portion of the slider 30 (the right end portion in the figures), there is formed a flagpiece 45 which abuts against a projection 44 protruding from the lower end of the carriage 1 when the carriage 1 is located at the position where the first and second cap members 31 and 32 oppose the respective first and second recording heads 7 and 8. An engaging piece 46 is disposed at a position which is closer to the tip end than the flagpiece 45, so as to make contact with and separate from a guide member 47 fixed to a base 53.

The guide member 47 comprises a projection 47*a* which prevents the slider 30 from slipping off, a flat face 47*b* which forms a fixed gap suitable for an idle ejection between the slider 30 and the lower ends of the recording heads 7 and 8, a flat face 47*c* which forms a position where the cap members 31 and 32 resiliently contact the recording heads 7 and 8, and a slant face 47*d* extending between the two flat faces.

A shaft 50 extending in a direction perpendicular to the moving direction of the carriage 1 is disposed at the center of the lower portion of the slider 30. Both ends of the shaft 50 are loosely fitted into a lever 52. The lower end of the lever is swingably attached to a shaft 54 of the base 53 through a slot 52*a*. An upper end of a coil spring 56 which is slightly buckling toward the nonprinting region is attached to the slider 30. The lower end of the coil spring 56 is fixed to the base 53, and inclined toward the printing region.

According to this configuration, during a noncapping period, the slider 30 is urged toward the printing region by the coil spring 56 while one end of the slider is restricted by the lowest end of the slant face 47*b* of the guide member 47, and the center portion by the lever 52. This allows the cap members 31 and 32 to be kept at a position where a gap g can be formed in a degree adequate for an idle ejection without making the cap members contact the recording heads 7 and 8.

The slider 30 has a valve unit 60 (FIG. 3) disposed at a position in a side of a case 61. The valve unit 60 is communicated with air release ports 31*b* and 32*b* formed in the respective cap members 31 and 32. An operation rod 62 protrudes from the valve unit 60. When the slider 30 is moved to the capping position, the operation rod 62 resiliently abuts against the case 61, whereby the valve unit 60 which is normally opened is closed so that the air release ports 31*b* and 32*b* are closed.

Figure 5:
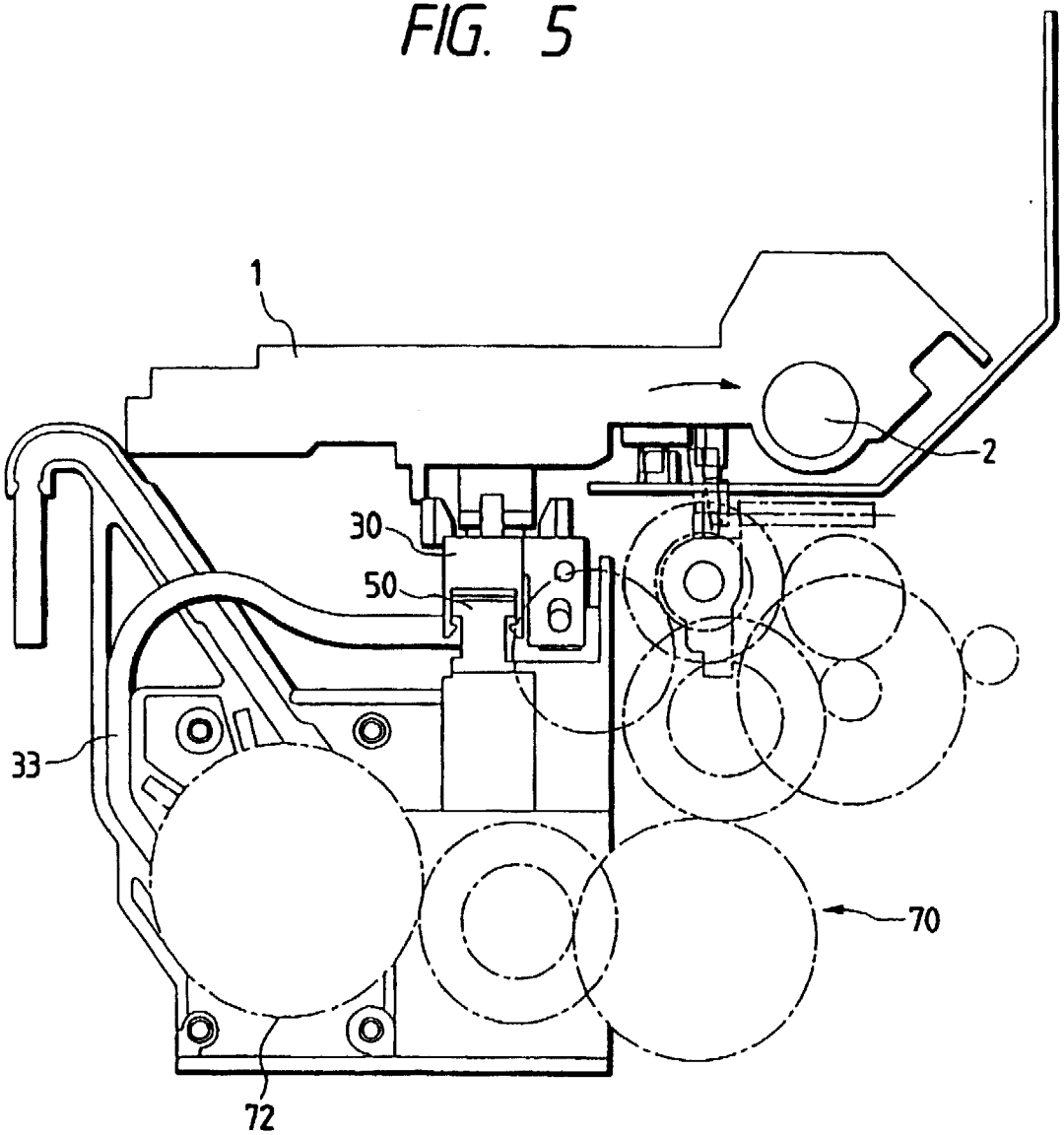
FIG. 5 is a diagram showing the state where a sheet feed and pump motor is coupled with a tube pump.
Figure 6:
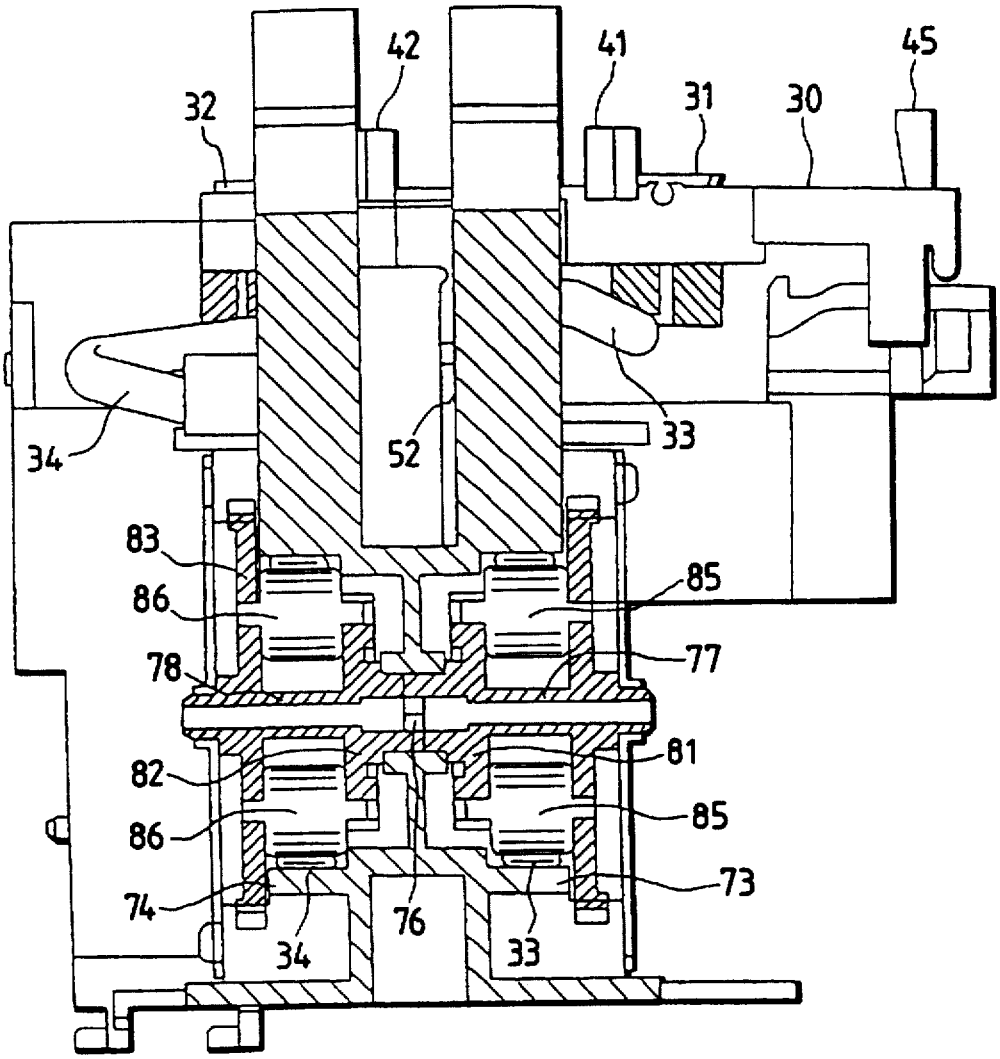
FIG. 6 is a diagram showing the structure of a longitudinal section of the tube pump.
Figure 7:
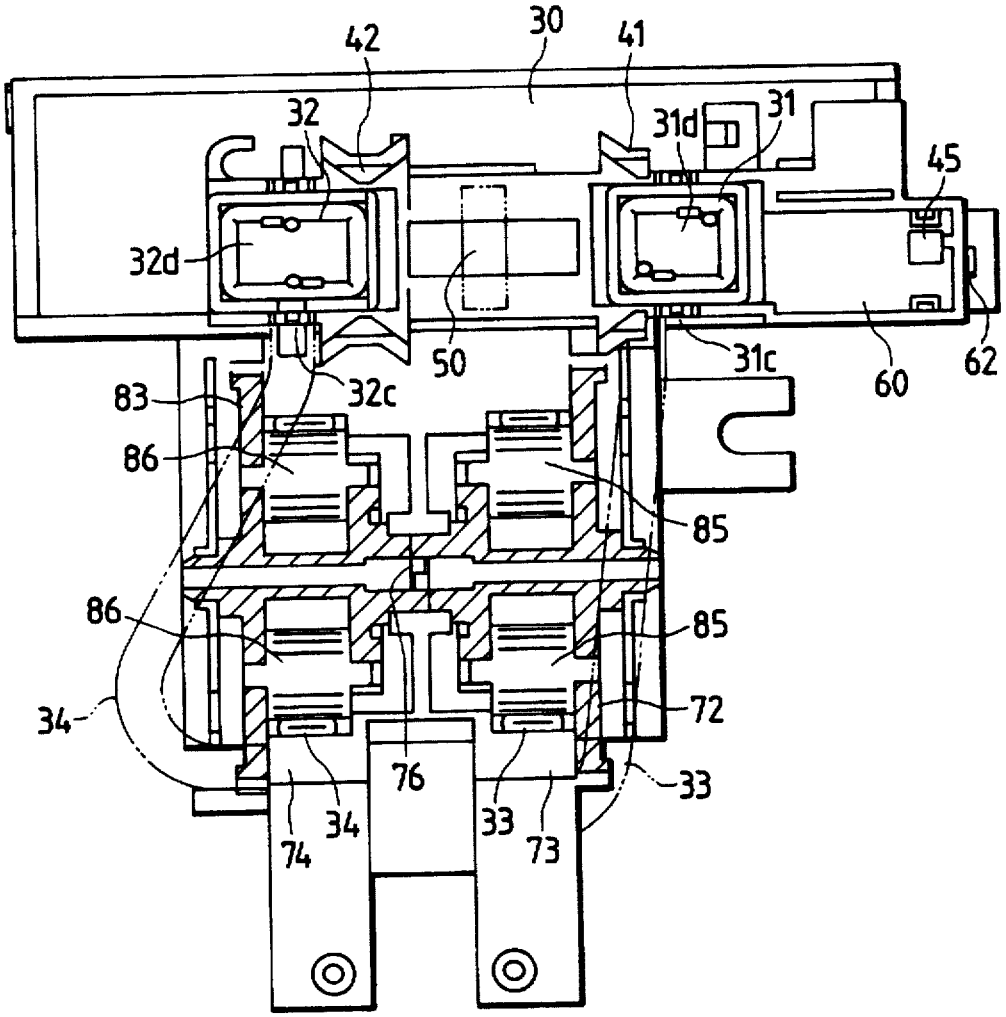
FIG. 7 is a diagram showing the structure of a cross section of the tube pump.

FIGS. 5, 6 and 7 show an embodiment of the pump units 13 (see FIG. 1). A driving wheel 72 of the pump 37 (see FIG. 3) is coupled with the pulse motor 24 through a wheel train 70. The pump tubes 33 and 34 through which the cap members 31 and 32 are communicated with a waste ink tank (not shown) are covered by cover cases 73 and 74, respectively, so that the outer side of each tube is formed into a substantially circular shape. The inner sides of the pump tubes 33 and 34 can be resiliently pressed by rollers 85 and 86 (see FIGS. 6 and 7).

The two sets of rollers 85 and 86 are movably and loosely fitted into slots formed in a train of driving wheels 72, 81, 82 and 83 which are fixed to the both ends of rotation shafts 77 and 78. The rotation shafts 77 and 78 are coupled with each other through a connecting member 76. The slots are described in greater detail below.

FIGS. 8(*a*) and 8(*b*) show an embodiment of the above-mentioned guide slots 90 which are formed in the driving wheels supporting the rollers 85 and 86. The guide slots 90 are formed as slots which extend in such a manner that the distance between the slot and the center of the respective driving wheel is gradually changed. When the sheet feed and pump motor 24 is reversely rotated (arrow A), the shafts 85*a* of the rollers 85 are moved along the respective slots 90 toward the outer periphery.

In the first tube pump 37, this causes the rollers 85 to be rotated while pressing against the tube 33, thereby generating a suction force. When the motor 24 is forward rotated (arrow B), the shafts 85*a* of are moved toward the center and the rollers 85 are separated from the tube 33 so that the pump operation is discontinued.

The second tube pump 38 is configured so as to operate in a manner that is the reverse of the first tube pump 37. Specifically, when the motor 24 is reversely rotated, the rollers 86 are moved toward the center so that the pump operation is discontinued, and, when the motor 24 is forward rotated, the rollers 86 are moved toward the outer periphery so as to be rotated while pressing against the tube 34, thereby generating a suction force.

In this way, the pump which is to generate a suction force can be selected by switching the rotation direction of the motor 24. In the figures, reference numeral 92 designates a roller pressing piece which is made of an elastic material such as rubber. When the driving wheel 72 is rotated, the roller pressing piece 92 resiliently presses against the rollers 85 so that the rollers 85 are moved along the respective slots 90 to the position corresponding to the rotation direction of the motor.

FIG. 9 shows an embodiment of a control device. In the figure, reference numeral 100 designates an idle ejection control means which receives a signal from a printing process monitor means 101 to monitor the current position of the carriage 1. At the instant when a signal is output from first to third timer means 102 to 104 and sheet supply and discharge detection means 105, the idle ejection control means 100 reads out data from an idle ejection data storage means 106, and drives carriage control means 107 and idle ejection drive signal output means 108.

When the first ink jet recording head 7 conducts an idle ejection during a printing process, the first timer means 102 is reset, and, when the second ink jet recording head 8 conducts an idle ejection, the second timer means 103 is reset. The first and second timer means measure the period which elapses before the next idle ejection is conducted. The third timer means 104 measures the wait period which starts when the printing operation is ended and ends with the input of the next printing data.

As shown in FIG. 10, the idle ejection data storage means 106 stores: a period $T_1$ between idle ejections of a recording head in which the drying index of ink is relatively high, or the first recording head 7 in the embodiment; the number of ink drops to be ejected; a period $T_2$ between idle ejections of the second ink jet recording head 8 in which the drying index of ink is relatively low; and the number of ink drops to be ejected.

The carriage control means 107 controls the carriage motor 23 in the following manner. When only the nozzle openings in which the drying index of ink is relatively high, i.e., the first recording head 7 in the embodiment, are to conduct an idle ejection, the first recording head 7 is positioned in a capping region which is located as close to the printing region as possible, i.e., at the second cap member 32 in the embodiment. When all the nozzle opening trains, i.e., both the first and second recording heads 7 and 8 in the embodiment, are to conduct an idle ejection, the recording heads 7 and 8 are opposed to the cap members 31 and 32, respectively.

The idle ejection drive signal output means 108 selectively outputs drive signals including, for example, a drive signal the level of which is gradually increased in the sequence of $V_1$, $V_2$, $V_3$, . . . with the lapse of time as shown in FIGS. 11(*a*) and (*b*), and a drive signal the driving timing of which is gradually shortened in the sequence of $T_1$, $T_2$, $T_3$, . . . with the lapse of time (FIGS. 11(*c*) and (*d*)).

In the case where an idle ejection is regularly conducted at a relatively short period, such as an idle ejection process during the printing step, the ink ejection ability of the nozzle opening trains can be restored by supplying a drive signal similar to that used in the printing step. In the case where the recording heads are left in the capped state for a long time, however, the viscosity of ink in the nozzle openings is increased to a very high value.

When a normal drive signal is applied in the latter case, a very high pressure is generated in a pressurizing chamber potentially causing problems with a vibrating plate or other components of the print heads. To eliminate this problem, the driving operation is conducted in such a manner that the driving voltage is initially lowered in level to about 90% of the normal value and the period is slightly prolonged as required, whereby ink is caused to gradually ooze out of the nozzle openings for a relatively long period of time.

When the viscosity is then reduced to a lower degree, the recording heads are driven by a drive signal which is higher in level and shorter in period than that used in the normal printing process, so that ink in the vicinity of the nozzle openings is ejected in a single step.

The operation of the thus configured apparatus will be described with reference to the flowchart shown in FIG. 12.

When a print signal is supplied from a host computer which is not shown (step A), the pulse motor 23 is driven to move the carriage 1 to the printing region. At the same time, the first and second timer means 102 and 103 are set to start the measurement of elapsed time (step B). When print data are input under this state, the printing process is started, and black ink is ejected from the nozzle openings of the first recording head 7 and colored inks are ejected from those of the second recording head 8 (step C).

When the contents of the first timer means 102 reach the period (2 seconds) which coincides with the longest one of the idle ejection periods, the printing operation is stopped in the course of printing one line, and the process jumps to step G. It is checked whether the longest idle ejection period (2 seconds in the embodiment) has elapsed or not (step E).

When the contents of the first timer means 102 reach the shortest idle ejection period of 2 seconds (step D) during the printing operation as described above, the idle ejection control means 100 waits for a one-reciprocation printing end signal from the printing process monitor means 101 (step F). When one-reciprocation printing is completed (step F), before the contents of the first timer means 102 reach the shortest idle ejection period of 2 seconds and a predetermined period $\Delta T$ of, for example, 1 second which is required for one-reciprocation printing is further elapsed (step E), the idle ejection control means 100 judges whether the period $T_2$ of the second timer means 103 exceeds the shortest idle ejection period (6 seconds in the embodiment) stored in the idle ejection data storage means 106 or not (step G). In this case, since the reciprocation printing is ended at the instant when the period of 2 seconds has elapsed after the start of the printing, only a period of $\Delta T_1$ has elapsed with the result that only a period of 2.5 seconds has elapsed after the start of the printing. Therefore, the first recording head 7 is moved by the carriage control means 107 to position 1 (FIG. 15(*c*)) which opposes the second cap member 32 located in the side of the printing region ((step H).

As shown in FIG. 17, this causes the first recording head 7 to oppose the second cap member 32 which is the one closest to the printing region, and the second recording head 8 to be situated at a position opposing neither one of the cap members. The first recording head 7 which must be subjected to an idle ejection can be moved with a moving distance as short as possible, to a position where an idle ejection can be conducted. This improves the total printing speed.

Under this state, the idle ejection control means 100 reads out the period $T_1$ measured by the first timer means 102, and reads out from the idle ejection data storage means 106 the number of ink drops to be ejected (10 drops in the embodiment) which corresponds to the read out period (e.g., 2.5 seconds) (step I). The idle ejection control means controls the idle ejection drive signal output means 108 to output a drive signal so that all nozzle openings of the first recording head 7 eject ink drops (step J). When 10 drops have been ejected, the ejection is stopped (step K).

Consequently, ink of the amount corresponding with the drying degree of the nozzle openings is ejected. Even in a nozzle opening which did not eject an ink drop in the printing process, the increased viscosity of ink can be surely eliminated. Furthermore, as describe above, even after the idle ejection period ended, one-reciprocation printing is completed and an idle ejection is then executed at a position which is closest to the printing region. Therefore, the carriage 1 is not required to be uselessly moved so that the total printing speed is improved.

In the case where the contents of the first timer means 102 reach a period of (the shortest ejection period+$\Delta T$) during the period when one-reciprocation printing has not been completed (step F), there may be a fault or the like. Therefore, the carriage is moved to position 2 to be subjected to the capping process (step T), and the apparatus then waits the next instruction.

When the idle ejection is completed, the idle ejection control means 100 resets only the first timer means 102 for measuring the idle ejection period of the first recording head 7 which has conducted the idle ejection, and controls the timer means so as to restart the time measuring operation (step L).

FIG. 16 is a graph showing the relationships between the idle ejection period and the number of ink drops to be ejected which is required for restoring the ink ejection ability of nozzle openings. As the period of the idle ejection is made longer, the number of ink drops to be idly ejected is rapidly increased, and numbers of ink drops required for restoring the ink ejection ability are scattered, thereby reducing the reliability of the operation of restoring the ink ejection ability. When an idle ejection is executed frequently, therefore, ink consumption can be suppressed and the ink ejection ability can be surely restored with a high reliability.

In the step where the idle ejection of the first recording head 7 is ended as described, print data remain to be output because the idle ejection was conducted during the printing process in the above-described example (step M). Therefore, the carriage 1 is moved to the printing region and the printing process is resumed (step C).

When, in the next printing process, the contents of the first timer means 102 reach again the shortest idle ejection period (2 seconds) (step D), the process enters step G via steps E and F.

In the above-described example, since the printing time of the second recording head 8 has already exceeded the shortest idle ejection period (6 seconds) (step G), the idle ejection control means 100 controls the carriage 1 so as to be moved to position 2 (FIG. 15(*d*)) (step N).

This causes the projection 44 disposed at the front end of the carriage 1 to abut against the flagpiece 45 of the slider 30 as shown in FIG. 18, resulting in that the first and second cap members 31 and 32 oppose the respective first and second recording heads 7 and 8 of the carriage 1 while being separated therefrom by the fixed gap g.

Under this state, the idle ejection control means 100 reads out the period $T_1$ which has elapsed after the first recording head 7 conducted the previous idle ejection, from the first timer means 102. The control means reads out also the period $T_2$ when the second timer means 103 counts up, from the second timer means 103, and the numbers of ink drops which are respectively required for idle ejections of the first and second recording heads 7 and 8, from the idle ejection data storage means 106 (step O).

Specifically, 10 ink drops are allocated to the recording head 7 in which the period $T_1$, for example, 2.5 seconds has elapsed after the previous idle ejection, and 15 ink drops are allocated to the second recording head 8 in which the period $T_2$, for example, 7 seconds has elapsed.

The idle ejection drive signal output means 108 outputs to the recording heads 7 and 8 drive signals for the numbers of ink drops which are to be ejected by the recording heads 7 and 8, so that all nozzle openings of the first and second recording heads 7 and 8 eject ink drops (step P). When a predetermined number of ink drops are ejected, the idle ejections are stopped (step Q). This enables the idle ejection of the recording head 8 in which the drying index of ink is relatively low and a long period is set for an idle ejection, to be executed in accordance with an idle ejection of the recording head 7 in which a relatively short period is set for an idle ejection. Therefore, the printing process is interrupted a reduced number of time so that the total printing speed is improved.

When the idle ejections are ended, the idle ejection control means 100 resets both the first and second timer means 102 and 103, and then causes the both means to start the time measuring operation (step R).

Next, the printing process is continued by repeating the above-mentioned steps. When there remains no data to be printed (step M), the carriage 1 is moved to position 2 (step S), and the capping process is then conducted (step T).

When the carriage 1 is further moved toward the outer region (the right side in the figure) under the state where the carriage 1 is situated at position 2 (FIG. 15(*d*)) or the recording heads 7 and 8 respectively oppose the cap members 31 and 32, the carriage 1 applies a force to the flagpiece 45 of the slider 30 via the projection 44 of the carriage 1, and the lever 52 which is subjected to the urging force of the coil spring 56 that is slightly buckling at its upper portion in the moving direction of the carriage 1 applies a resistance force to the slider 30. Therefore, the slider 30 inclines forward as shown in FIG. 19 so that a force is exerted to lift up the rear end of the slider 30 as indicted by an arrow D in the figure.

As a result, the rear portion of the slider 30 is lifted up while the shaft 50 functions as the rotation fulcrum, so that the second cap member 32 which is located at a more rearward position than the shaft 50 (in the side of the printing region) first abuts against the second recording head 8. At this time, since the cap member 32 is attached to the slider 30 in a slightly swingable manner and the slider 30 is swingably attached to the base 53 through the lever 52, the cap member 32 is lifted up while being guided by the second recording head 8 and then abuts against the second recording head 8 at a position where the cap member can seal the head (FIG. 20).

When the carriage 1 is further moved toward the case 61, the force of the coil spring 56 is overcome by the force exerted by the carriage 1, and begins to buckle so that the slider 30 is lifted up. This causes the portion of the slider 30 in the side of the case to be lifted up while maintaining the state where the second cap member 32 is fitted over the second recording head 8, with the result that the first cap member 31 is fitted over the first recording head 7.

Since the slider 30 swings with respect to the base 53 and the first and second cap members 31 and 32 are somewhat swingable with respect to the slider 30 and configured by an elastic member, naturally, the cap members 31 and 32 are guided by the edges of the recording heads 7 and 8 and then fitted over the recording heads 7 and 8, respectively.

When the carriage 1 is further moved in this way, the slider 30 is horizontally moved toward the case 61 while the upper face of the slider is restricted by the recording heads 7 and 8. Then, the operation rod 62 protruding from the front end of the slider 30 abuts against the case 61 to be pressed so as to close the valve unit, whereby the air release ports 31*b* and 32*b* of the cap members 31 and 32 are isolated from the air. This prevents the vapors of the ink solvents retained by ink absorbers 31*d* and 32*d* from being scattered, so that the vicinity of the nozzle openings are moistened by the vapors of the ink solvents retained by ink absorbers 31*d* and 32*d* in the vicinity of the nozzle openings, whereby the nozzle openings are surely prevented from being dried.

When the printing operation is stopped by pressing a pause button or the like, the idle ejection control means 100 controls the carriage 1 to be moved to position 2 (step S), and the capping process is then conducted (step T).

The operation which, after printing on one recording sheet is completed, is to be conducted on the next recording sheet will be described with reference to the flowchart shown in FIG. 13.

When a sheet discharge instruction is input (step A), the idle ejection control means 100 controls the carriage 1 to be moved to position 2 (step B), so that the first and second cap members 31 and 32 oppose the respective first and second recording heads 7 and 8 while being separated therefrom by the fixed gap g (FIG. 18). A predetermined number of ink drops are ejected from the recording heads 7 and 8 (step C). When the idle ejections are ended, the sheet discharge process is executed (step D).

In the case where the next page is to be printed thereafter, the idle ejection control means 100 controls the recording heads 7 and 8 to idly eject a predetermined number of ink drops (step F) before the sheet supplying process is conducted (step E). When the idle ejections are ended, a preparatory operation for the sheet supply is executed (step G), and the recording heads 7 and 8 again conduct the idle ejection (step H). The recording sheet is advanced so that the beginning of the printing area opposes the recording heads (step I), and the recording heads 7 and 8 idly eject a predetermined number of ink drops (step J). The first to third timer means 102 to 104 are reset, and then start the time measuring operation (step K).

As described above, each time when the operation of each step in the sheet discharging and supplying processes is ended, a fixed number of ink drops are idly ejected to prevent the viscosity of ink in the nozzle openings from increasing, and the recording heads wait in a condition that the printing process can be started as soon as the input of print data is started, i.e., the operation of removing the cap members 31 and 32 is not required to be conducted.

In the case where the next page is not to be printed thereafter and hence the sheet supply is not conducted (step E), the first and second recording heads 7 and 8 idly eject a predetermined number of ink drops (step L), and the capping process is then conducted (step M).

In the embodiment described above, both the first and second recording heads 7 and 8 conduct the idle ejection each time when the sheet discharging process, the sheet supplying process or the process of positioning the beginning of the printing area is conducted. When the idle ejection period of one of the recording heads, for example, the recording head 8 is longer than the period required for conducting each of the processes, the idle ejection operation of the recording head 8 may be omitted.

The operation conducted between the step of loading a new recording sheet and the start of the printing process will be described with reference to the flowchart shown in FIG. 14.

In the case where data exist for the next printing process at the instant when the sheet supplying process is ended (step A), the fetching of the data is started (step B).

In the case where the fetching of data suitable for printing, e.g., data of one line is completed (step C) before the measured period $T_3$ of the third timer means 104 which is set at the end of the immediately preceding sheet supplying process (step K of FIG. 13) reaches the second reference (5 seconds in the embodiment) (step I), the idle ejection control means 100 reads out in step D the measured periods $T_1$ and $T_2$ of the first and second timer means 102 and 103 which are similarly set at the end of the immediately preceding sheet supplying process (step K of FIG. 13), and determines the numbers of ink idle ejections which are to be conducted by the recording heads 7 and 8, from the data of the idle ejection data storage means 106 (step E). The recording heads 7 and 8 then execute the idle ejection toward the respective cap members 31 and 32 which oppose the recording heads (step F).

After the idle ejections, the timer means 102, 103 and 104 are reset, and the timer means 102 and 103 newly start the time measuring operation (step G). Then the printing process shown in the flowchart of FIG. 12 is started (step H).

In contrast, in the case where the measured period $T_3$of the third timer means 104 reaches the second reference (5 seconds in the embodiment) in the course of the process of fetching data (step I), the idle ejection control means 100 controls the recording heads 7 and 8 to idly eject a predetermined number of ink drops in the state where the recording heads are opposed to the cap members 31 and 32, respectively (step J), resets the first to third timer means 102 to 104 after the idle ejections (step K), and then conducts the capping process (step L). The recording heads 7 and 8 wait for the completion of the process of fetching data, while the viscosity of ink in the vicinity of the nozzle openings is prevented by the cap members 31 and 32 from being increased (step M). When the process of fetching data is completed, the recording heads 7 and 8 are separated from the cap members 31 and 32, the carriage 1 is moved to the printing region and the printing is then conducted (step H).

In the case where the sheet supplying process is ended but there exists no print data (step A), the data input is waited for without conducting the capping process until the contents of the third timer means 104 reach the first reference (5 seconds in the embodiment). When the first reference period has elapsed, steps J and K described above are conducted, the capping process is conducted (step L), and the completion of the process of fetching data is waited for (step M). In the normal printing process, therefore, the printing operation can be executed at a speed as rapid as possible while preventing the viscosity of ink from being increased. In the case where graphic data or the like which require a prolonged data transfer period are to be printed, the completion of the data transfer can be waited for while ink consumption due to an idle ejection is prevented from occurring.

Preferably, the pumps are operated so as to suck ink before the capping process is started.

This will be described more specifically below. At the instant when the idle ejections are completed, the ink ejected to the cap members 31 and 32 has not been absorbed completely by the ink absorbers 31*d* and 32*d*, respectively, as shown in FIG. 22(*a*) with respect to the cap member 31. Therefore, there is a danger that the ink which has once been ejected is deposited on the nozzle opening faces. To prevent this, the pump 37 is operated to suck an excess of ink. Irrespective of the state of a valve 45, i.e., whether the valve is opened or closed, only ink in the vicinity of the suction port 31*a* which is communicated with the pump 37 is selectively removed away, and residual ink existing at a position remote from the suction port 31*a* equally disperses in the ink absorber 31*d*. Therefore, an excess of ink can be removed, and the ink absorber 31*d* can hold an adequate amount of ink which can keep the nozzle openings moist in the capping process.

When the cap members 31 and 32 abut against the recording heads 7 and 8 and the pump 37 is then operated, ink deposited between the valve 45 and the air release port 31*b* is sucked out because the valve 45 is opened under the state where only the abutment between the members and the recording heads is established, thereby preventing fixation of the valve 45 due to dried ink in the vicinity of the valve 45 from occurring.

When the recording heads 7 and 8 in the capped state are moved to the right side in the figure, the valve 45 is opened. When the pump is operated under this state, therefore, a negative pressure is applied to the nozzle openings so that ink is forcibly ejected irrespective of the increased degree of the viscosity of ink in the vicinity of the nozzle openings.

The embodiment in which the nozzle openings of the recording heads are directed downward has been described above. It is a matter of course that, even in the case where nozzle openings of recording heads are directed upward or horizontally, the same effects can be attained by disposing the caps so as to correspond to the arrangement of the recording heads, i.e., to oppose the nozzle opening faces.

Although the embodiment in which the invention is applied to a color printer has been described, it is a matter of course that the same effects can be attained even when the invention is applied to a printer in which two ink jet recording heads ejecting drops of ink of the same color are mounted on one carriage so as to improve the recording density.

In the embodiment, the cap members which are independent from each other are allocated to the recording heads, respectively. It is a matter of course that the same effects can be attained even when a single cap member which can seal two recording heads is used.

In the embodiment, the recording heads which eject inks respectively containing ink solvents of different evaporation rates are independently mounted. As shown in FIG. 23(*a*), a single recording head may be configured by forming nozzle trains 110 and 111 through which inks respectively containing ink solvents of different evaporation rates are respectively ejected, in the same substrate 112. It is obvious to those skilled in the art that the invention can be applied similarly to a printer in which such a recording head is sealed by a single cap member 113.

In this alternative, the nozzle train 110 for ejecting ink having a higher drying index 110 may be disposed outside the printing region. When only the nozzle train 110 is to conduct an idle ejection, therefore, it is required to move only the nozzle train 110 so as to oppose the cap member 113 as shown in FIG. 23(*b*).

As described above, the apparatus of the invention comprises: a plurality of ink jet recording heads which are arranged in a moving direction of a carriage at fixed intervals; cap members which are disposed outside a printing region and which seal the ink jet recording heads, respectively; timer means for detecting elapsed time during which the ink jet recording heads conduct an idle ejection; and control means for disposing an ink jet recording head for ejecting ink having a lower drying index among the ink jet recording heads, to the side of the printing region, and when only an ink jet recording head for ejecting ink having a higher drying index is to conduct an idle ejection, locating the ink jet recording head for ejecting ink having a higher drying index in the printing region side of the cap members.

Therefore, the moving distance of the carriage in an idle ejection can be shortened to a value as small as possible and the total printing speed can be improved.

What is claimed is:

1. An ink jet recording apparatus having a carriage and a printing region, and comprising:

a plurality of ink jet recording heads for ejecting ink, arranged on said carriage, and spaced apart at fixed intervals in a moving direction of said carriage, said plurality of ink jet recording heads including a first head and a second head, each of said plurality of ink jet recording heads having respective ink with a respective drying index, said first head having first ink as said respective ink, said first ink having a first drying index as said respective drying index, said second head having second ink as said respective ink, said second ink having a second drying index as said respective drying index, said first drying index being higher than said second drying index; and cap members, disposed outside said printing region, for sealing said plurality of ink jet recording heads, and including a first cap member and a second cap member, said first cap member being positioned further from said printing region than said second cap member, said plurality of ink jet recording heads being arranged on said carriage so as to correspond to said cap members on a basis of said respective drying index of said respective ink, said first head thereby corresponding to said first cap member and said second head thereby corresponding to said second cap member.

2. The ink jet recording apparatus according to claim 1, wherein:

said ink jet recording apparatus further comprises a controller including:

carriage movement control means for controlling movement of the carriage, and timer means for timing an elapsed time between successive idle ejections of each of said plurality of ink jet recording heads:

said controller controls said carriage movement control means based on an output of said timer means;

said carriage movement control means moving said carriage so that said first head is positioned outside the printing region to oppose one of said cap members when said first head conducts one of said idle ejections and said second head does not.

3. An ink jet recording apparatus according to claim 2, wherein:

said apparatus further comprises idle ejection data storage means for storing at least two kinds of timing data, including long and short period timing data for executing the idle ejections in accordance with ink drying indices of different types of ink in said ink jet recording heads, and for storing data corresponding to predetermined numbers of ink drops for ejection from the ink jet recording heads during the idle ejections, the short period timing data corresponds to said first head, and the long period timing data corresponds to said second head.

4. The ink jet recording apparatus according to claim 3, wherein;

when said timer means detects said elapsed time corresponding to the short period timing data, said carriage movement control means controls the movement of the carriage in accordance with the short period timing data so that said first head is positioned to oppose said second cap member, and when said timer means detects said elapsed time corresponding to the long period timing data, said carriage movement control means executes a wait command to wait until said timer means next detects said elapsed time corresponding to the short period timing data, whereupon said carriage movement control means controls the movement of the carriage so that said first head opposes said first cap member and said second head opposes said second cap member.

5. An ink jet recording apparatus having a carriage, and comprising:

an ink jet recording head disposed on the carriage, said ink jet recording head having a plurality of nozzle opening trains, including a first and a second nozzle opening train, for ejecting at least two different inks having different respective drying indices, said first nozzle opening train ejecting a first ink having a first drying index, said second nozzle opening train ejecting a second ink having a second drying index lower than said first drying index;

cap members which are disposed outside a printing region and which seal said ink jet recording head; and said first nozzle opening train being arranged on the carriage on a basis of said first drying index, so that when said plurality of nozzle opening trains faces said cap members, said first nozzle opening train is disposed further from said printing region than said second nozzle opening train.

6. The ink jet recording apparatus according to claim 5, wherein:

said ink jet recording apparatus further comprises a controller including:

carriage movement control means for controlling movement of the carriage, and timer means for timing an elapsed time between successive idle ejections of each of said plurality of ink jet recording heads;

said controller controls said carriage movement control means based on an output of said timer means;

said carriage movement control means moving said carriage so that said first nozzle opening train is positioned outside the printing region to oppose one of said cap members when said first nozzle opening train conducts one of said idle ejections and said second nozzle opening train does not.

7. An ink jet recording apparatus according to claim 6, wherein:

said apparatus further comprises idle ejection data storage means for storing at least two kinds of timing data, including long and short period timing data for executing the idle ejections in accordance with ink drying indices of different types of ink in said nozzle opening trains, and for storing data corresponding to predetermined numbers of ink drops for ejection from the nozzle opening trains during the idle ejections, the short period timing data corresponds to said first nozzle opening train, and the long period timing data corresponds to said second nozzle opening train.

8. The ink jet recording head according to claim 7, wherein:

when said timer means detects said elapsed time corresponding to the short period timing data, said carriage movement control means controls the movement of the carriage in accordance with the short period timing data so that said first nozzle opening train is positioned to oppose said second cap member, and when said timer means detects said elapsed time corresponding to the long period timing data, said carriage movement control means executes a wait command to wait until said timer means next detects said elapsed time corresponding to the short period timing data, whereupon said carriage movement control means controls the movement of the carriage so that said first nozzle opening train opposes said first cap member and said second nozzle opening train opposes said second cap member.

9. An ink jet recording apparatus according to claim 2, further comprising drive signal generation means for outputting a drive signal, said drive signal having a level, said level of said drive signal being increased with said elapsed time during one of said idle ejections.

10. An ink jet recording apparatus according to claim 6, further comprising drive signal generation means for outputting a drive signal, said drive signal having a level, said level of said drive signal being increased with said elapsed time during one of said idle ejections.

11. An ink jet recording apparatus according to claim 2, further comprising drive signal generation means for outputting a drive signal, said drive signal having a period, said period of said drive signal being shortened with said elapsed time during one of said idle ejections.

12. An ink jet recording apparatus according to claim 6, further comprising drive signal generation means for outputting a drive signal, said drive signal having a period, said period of said drive signal being shortened with said elapsed time during one of said idle ejections.

13. An ink jet recording apparatus according to claim 1, wherein:

each of said cap members has a suction port which is connected to a suction pump, and an air release port communicating with an environment through valve means: and when one of said recording heads abuts against said cap member, said air release port is opened by said valve means, and a suction force is applied by the suction pump.

14. An ink jet recording apparatus according to claim 5, wherein:

each of said cap members has a suction port which is connected to a suction pump, and an air release port communicating with an environment through valve means; and when one of said recording heads abuts against said cap member, said air release port is opened by said valve means, and a suction force is applied by the suction pump.

* * * * *